US009630085B2

(12) United States Patent
Treadway et al.

(10) Patent No.: US 9,630,085 B2
(45) Date of Patent: Apr. 25, 2017

(54) MOTORIZED TRANSPORTATION DEVICE

(71) Applicant: ACTON, INC., Altadena, CA (US)

(72) Inventors: Peter Treadway, Arcadia, CA (US); Janelle Wang Treadway, Arcadia, CA (US); Jason Hill, Long Beach, CA (US); Hang Zheng, Pasadena, CA (US)

(73) Assignee: ACTON, INC., Altadena, CA (US)

( * ) Notice: Subject to any disclaimer, the term of this patent is extended or adjusted under 35 U.S.C. 154(b) by 0 days.

(21) Appl. No.: 14/598,045

(22) Filed: Jan. 15, 2015

(65) Prior Publication Data

US 2015/0196831 A1 Jul. 16, 2015

Related U.S. Application Data

(60) Provisional application No. 61/928,406, filed on Jan. 16, 2014.

(51) Int. Cl.

| | |
|---|---|
| ***A63C 5/08*** | (2006.01) |
| ***A63C 17/12*** | (2006.01) |
| ***A63C 17/26*** | (2006.01) |
| *A63C 17/00* | (2006.01) |
| *A63C 17/08* | (2006.01) |

(52) U.S. Cl.

CPC ..... *A63C 17/12* (2013.01); *A63C 17/262* (2013.01); *A63C 17/004* (2013.01); *A63C 17/006* (2013.01); *A63C 17/08* (2013.01)

(58) Field of Classification Search

CPC ..... A63C 17/12; A63C 17/262; A63C 5/08; B62K 3/002; B62K 7/007; B62K 17/043

USPC ..... 180/180, 181, 65.1, 65.51, 11, 229, 10

See application file for complete search history.

(56) References Cited

U.S. PATENT DOCUMENTS

| | | | | |
|---|---|---|---|---|
| 3,265,147 | A * | 8/1966 | Coordes | B60K 17/043 180/10 |
| 3,387,502 | A * | 6/1968 | Letourneau | B60K 17/043 180/339 |
| 3,581,682 | A * | 6/1971 | Kontranowski | B60K 7/0007 180/308 |
| 3,710,965 | A * | 1/1973 | Joosten | B66F 9/07563 180/11 |
| 5,913,937 | A * | 6/1999 | Lin | F16H 35/10 464/160 |
| 6,059,062 | A * | 5/2000 | Staelin | A43B 5/16 180/181 |
| 6,199,652 | B1 * | 3/2001 | Mastroianni | B60K 7/0007 180/229 |
| 6,321,863 | B1 * | 11/2001 | Vanjani | B60K 7/0007 180/206.5 |
| 6,345,678 | B1 * | 2/2002 | Chang | B62K 3/002 180/181 |
| 6,428,050 | B1 | 8/2002 | Brandley et al. | |
| 6,688,447 | B1 * | 2/2004 | Liu | E06B 9/68 160/133 |

(Continued)

FOREIGN PATENT DOCUMENTS

WO 2012/158199 A1 11/2012

*Primary Examiner* — Hau Phan

(57) ABSTRACT

A wheel assembly comprises a wheel, a transmission assembly mounted on the wheel, and a motor coupled to the wheel through the transmission assembly. The motor includes an axle extending in a radial direction of the wheel. The transmission assembly transmits a rotational motion of the axle to a rotational motion of the wheel.

29 Claims, 23 Drawing Sheets

(56) References Cited

U.S. PATENT DOCUMENTS

| | | | | |
|---|---|---|---|---|
| 6,974,399 | B2 * | 12/2005 | Lo | B62M 7/12 180/65.51 |
| 7,392,995 | B2 * | 7/2008 | Lin | B62B 1/18 180/65.1 |
| 7,475,611 | B2 * | 1/2009 | Yang | B60K 7/0007 180/65.51 |
| 7,699,130 | B2 * | 4/2010 | Palmer | B62K 3/002 180/180 |
| 8,096,378 | B2 * | 1/2012 | Xie | B60K 7/0007 180/65.51 |
| 8,167,074 | B1 | 5/2012 | Tsiyoni | |
| 8,991,532 | B2 * | 3/2015 | Wei | A61G 5/1032 180/65.51 |
| 2008/0053724 | A1 * | 3/2008 | Chiu | B60K 1/04 180/65.51 |
| 2008/0066979 | A1 * | 3/2008 | Carter | B60L 11/1861 180/65.51 |

* cited by examiner

MOTORIZED TRANSPORTATION DEVICE

CROSS REFERENCE TO RELATED APPLICATION

This application claims the benefit of U.S. Provisional Application No. 61/928,406, filed Jan. 16, 2014, the content of which is hereby incorporated by reference in its entirety.

FIELD OF THE DISCLOSURE

This disclosure relates, in general, to motorized transportation devices and, in particular, to a motorized wearable device for personal transportation.

BACKGROUND OF THE DISCLOSURE

Motorized vehicles, such as motorized scooters and mopeds, allow convenient transportation and can also provide personal enjoyment during leisure time. Conventional motorized vehicles, however, are difficult to use and require extensive practicing to ensure safety and efficiency. Many local communities require a license to operate the conventional motorized vehicles. When not in use, the conventional motorized vehicles require a parking space for proper storage. In addition, the conventional motorized vehicles are expensive and may require significant maintenance costs.

SUMMARY OF THE DISCLOSURE

In an embodiment, a wheel assembly comprises a wheel, a transmission assembly mounted on the wheel, and a motor coupled to the wheel through the transmission assembly. The motor includes an axle extending in a radial direction of the wheel. The transmission assembly transmits a rotational motion of the axle to a rotational motion of the wheel.

In another embodiment, a motorized transportation device comprises a base and at least one wheel assembly. The at least one wheel assembly comprises a wheel rotationally coupled to the base, a transmission assembly mounted on the wheel, and a motor coupled to the wheel through the transmission assembly. The motor includes an axle extending in a radial direction of the wheel. The transmission assembly transmits a rotational motion of the axle to a rotational motion of the wheel. The motorized transportation device further comprises a control system for controlling the motor.

In another embodiment, a wheel assembly comprises a wheel having a ring gear disposed on an inner circumference of the wheel and a motor disposed within the ring gear. The motor has a shaft and a gear mounted on an end of the shaft. The gear of the motor engages the ring gear of the wheel to transmit a rotational motion of the shaft to a rotational motion of the wheel.

BRIEF DESCRIPTION OF THE DRAWINGS

The accompanying drawings, which are incorporated in and constitute a part of this specification, illustrate several embodiments of the disclosure and together with the description, serve to explain the principles of the disclosure.

DESCRIPTION OF THE EMBODIMENTS

Figure 1:
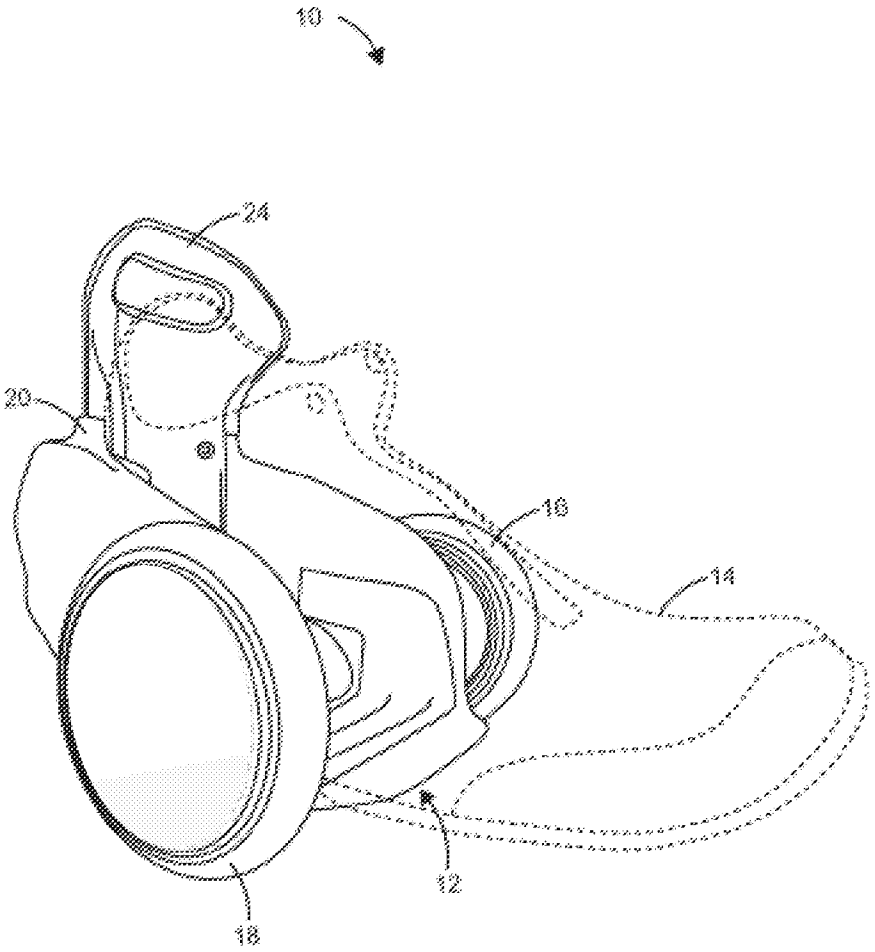
FIG. 1 is a perspective view of a motorized transportation device according to one embodiment.

Reference will now be made in detail to the present embodiments of the disclosure, examples of which are illustrated in the accompanying drawings. Wherever possible, the same reference numbers will be used throughout the drawings to refer to the same or like parts.

The drawings schematically show the structures of the motorized transportation device and its components. The shape of the device and its components may not be the same as shown in the drawings. A person having ordinary skill in the art should appreciate that the device and its components can be embodied with various shapes that can achieve the same functions.

Figure 2A:
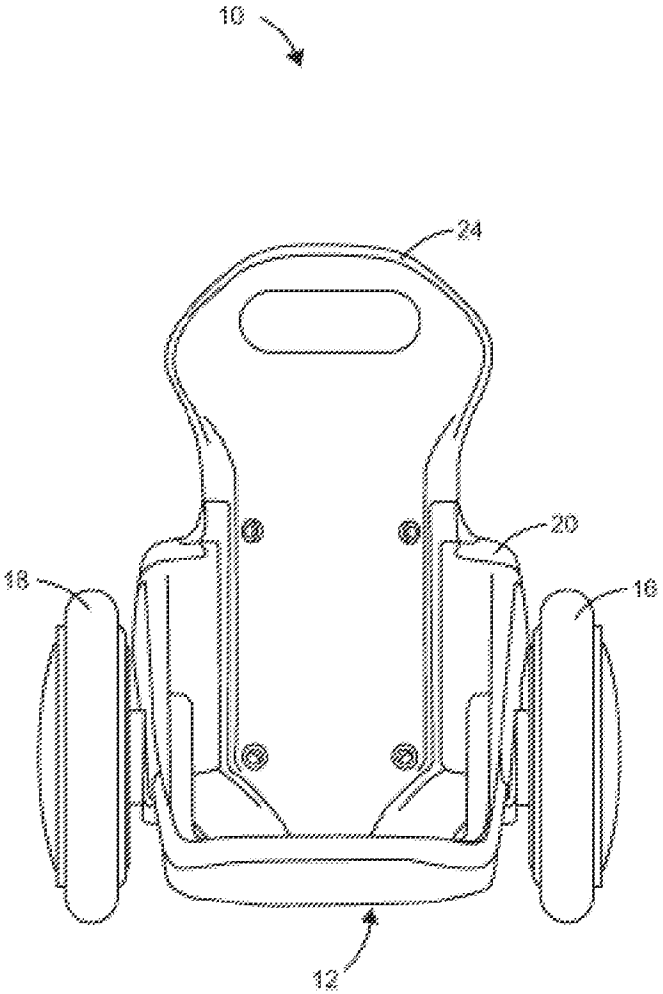
FIG. 2A is a front view of the motorized transportation device according to one embodiment.

FIGS. 1 and 2A illustrate an exemplary motorized transportation device 10 according to one embodiment. Motorized transportation device 10 comprises a base 12 for receiving a shoe 14 of a user and secure shoe 14 thereon. Base 12 may further include a battery pack 20.

Device 10 further includes one or more wheel assemblies, such as wheel assemblies 16 and 18, rotatably coupled to base 12. Wheel assemblies 16 and 18 have substantially same diameters and may be coupled to opposite sides of base 12. Wheel assemblies 16 and 18 may each have an electrical motor integrated therein for driving corresponding wheel assemblies 16 or 18. Alternatively, only one wheel assembly 16 or 18 includes the electrical motor. In some other embodiments, device 10 may have more than two wheel assemblies, for example, two wheel assemblies on each side. One or more wheel assemblies may have the electrical motor.

Transportation device 10 may receive control signals from a controller and vary the speed and direction of transportation device 10 according to the control signals. The controller may be embedded in base 12 of transportation device 10. The controller may include one or more tilt sensors and gyroscopic sensors that detect an angular position with respect to gravity. When a user wearing the transportation device 10 leans forward, the sensors may detect that, and the controller controls the motors to drive the wheel assemblies 16 and 18 to accelerate. When the user leans backward, the controller controls the motors to drive the wheel assemblies 16 and 18 to decelerate. According to an alternative embodiment, the control logic may be reversed. That is, a detection of forward leaning by the sensor may cause device 10 to decelerate, whereas a detection of backward leaning may cause device 10 to accelerate. The sensors may be analog or digital sensors as known in the art.

Transportation device 10 is suitable for use on surfaces, such as paved or unpaved roads in urban and rural areas. The user may wear transportation device 10 to walk, scoot, or roll without the need for removing shoe 14. Transportation device 10 can be easily removed, stored, and carried in a backpack accessory when not in use. Transportation device 10 may further include a handle flap 24 which may be made of rubber material, leather material, or the like.

According to one embodiment, device 10 may be attached and secured to the user's shoe via a locking mechanism including one or more straps or cables that wrap around portions of the shoe or foot. FIG. 2B illustrates an exemplary locking mechanism 100 for securing device 10 to a user's shoe 14. Wheel assemblies 16 and 18 are omitted in FIG. 2B for ease of illustration. Locking mechanism 100 may include a strap 101, a forefoot cross member 102, and a heel support member 105. Strap 101 may be connected to forefoot cross member 102 through a cable system, so that when strap 101 is pulled upwards, the cable system is tightened, thereby pressing forefoot cross member 102 against the user's shoe 14. Locking mechanism 100 may further include a locking device 109 to retain the position of strap 101, thereby maintaining the pressure on the user's shoe 14. Heel support member 105 may prevent the user's shoe 14 from moving backwards and provide additional security.

Figure 2C:
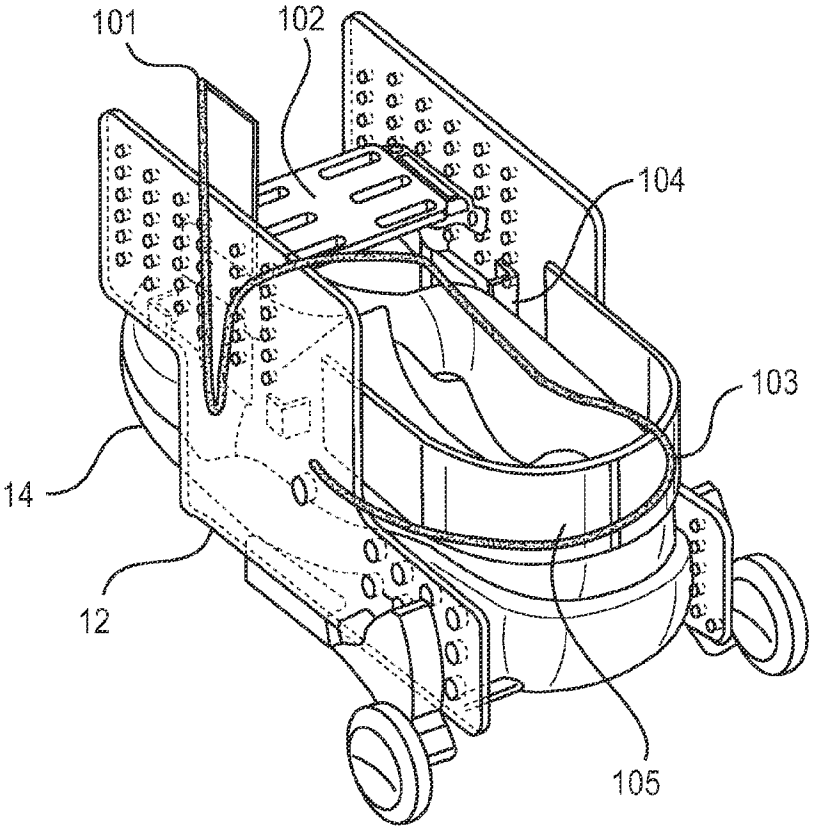
FIG. 2C illustrates an exemplary cable clinging system for securing the shoe of the user to the motorized transportation device.
Figure 2B:
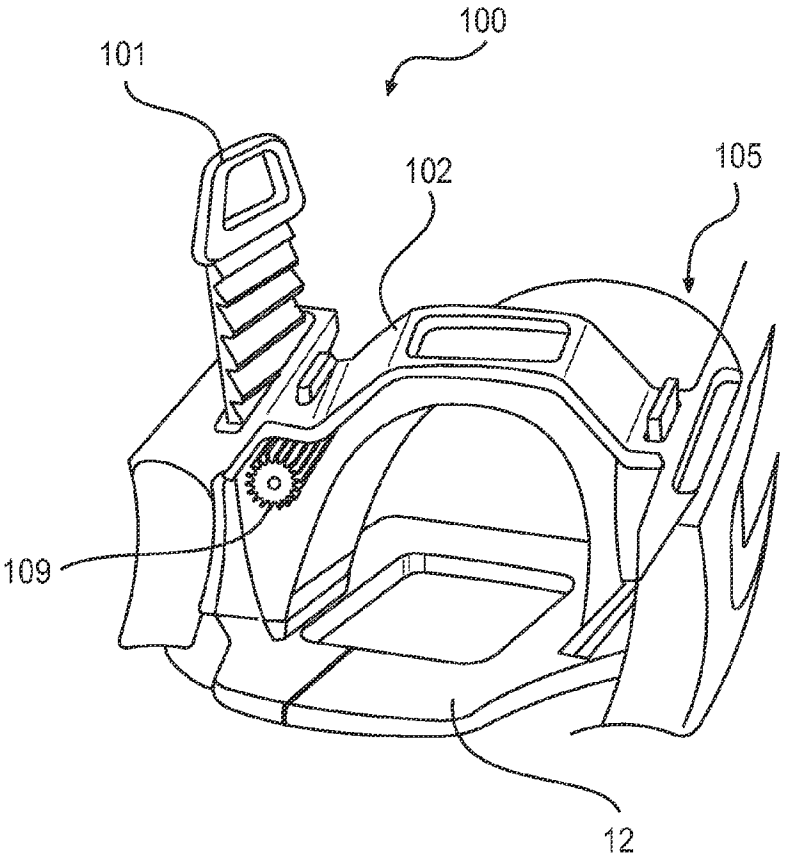
FIG. 2B illustrates an exemplary locking mechanism for securing a shoe of a user to the motorized transportation device.

According to a further embodiment as shown in FIG. 2C, locking mechanism 100 may include a cable system 103 that connects strap 101, cross member 102, and heal support member 105. FIG. 2C schematically shows the structures of these and other members. The shape of these and other members may not necessarily be the same as shown in the figure. A person having ordinary skill in the art should appreciate that the members can be embodied with various shapes that can achieve the same functions.

Wheel assemblies 16 and 18 are omitted in FIG. 2C for ease of illustration. When strap 101 is pulled upwards, cable system 103 may be tightened, thereby pressing cross member 102 and heel support member 105 against the user's shoe 14. As a result, the user's shoe 14 may be secured within base 12 by locking mechanism 100. Locking mechanism 100 may further include a cable support 104 for guiding cable system 103 from cross member 102 to heel support member 105.

Figure 2D:
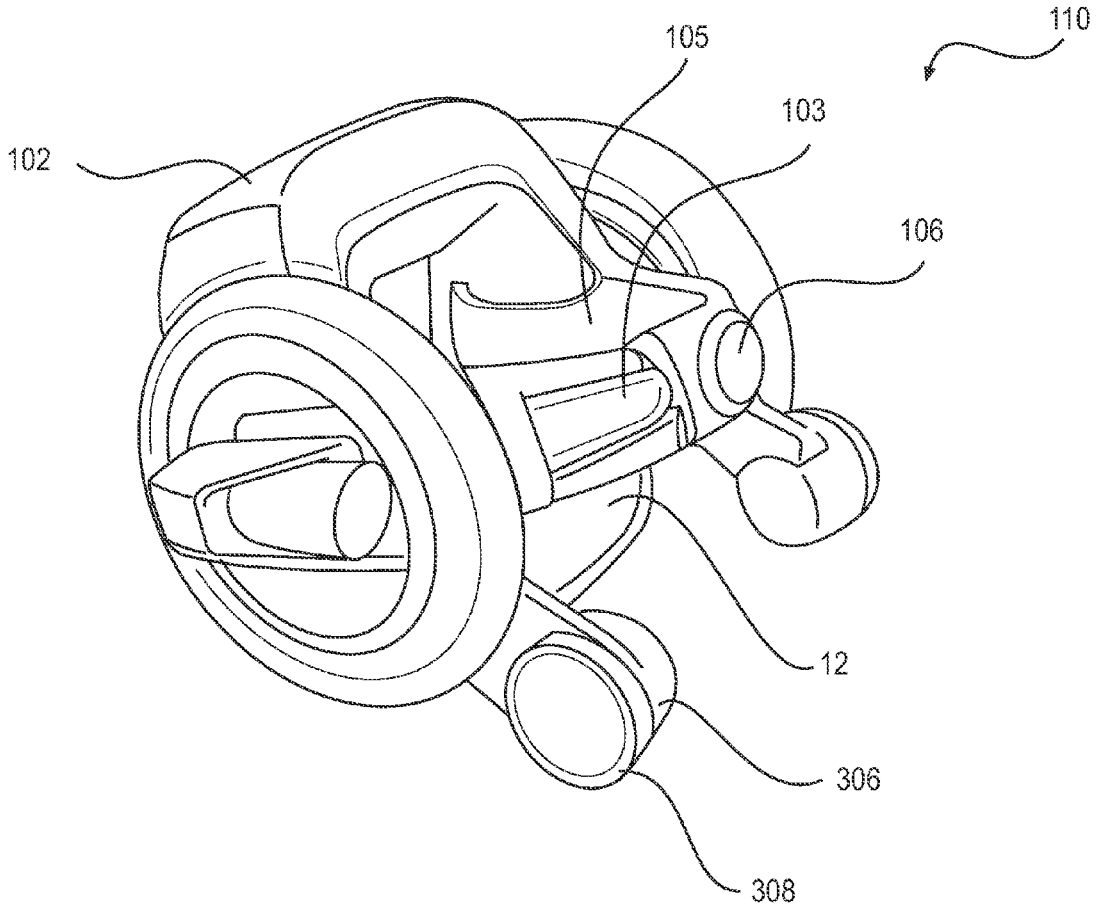
FIGS. 2D-2F illustrate another exemplary cable clinging system for securing the shoe of the user to the motorized transportation device.
Figure 2E:
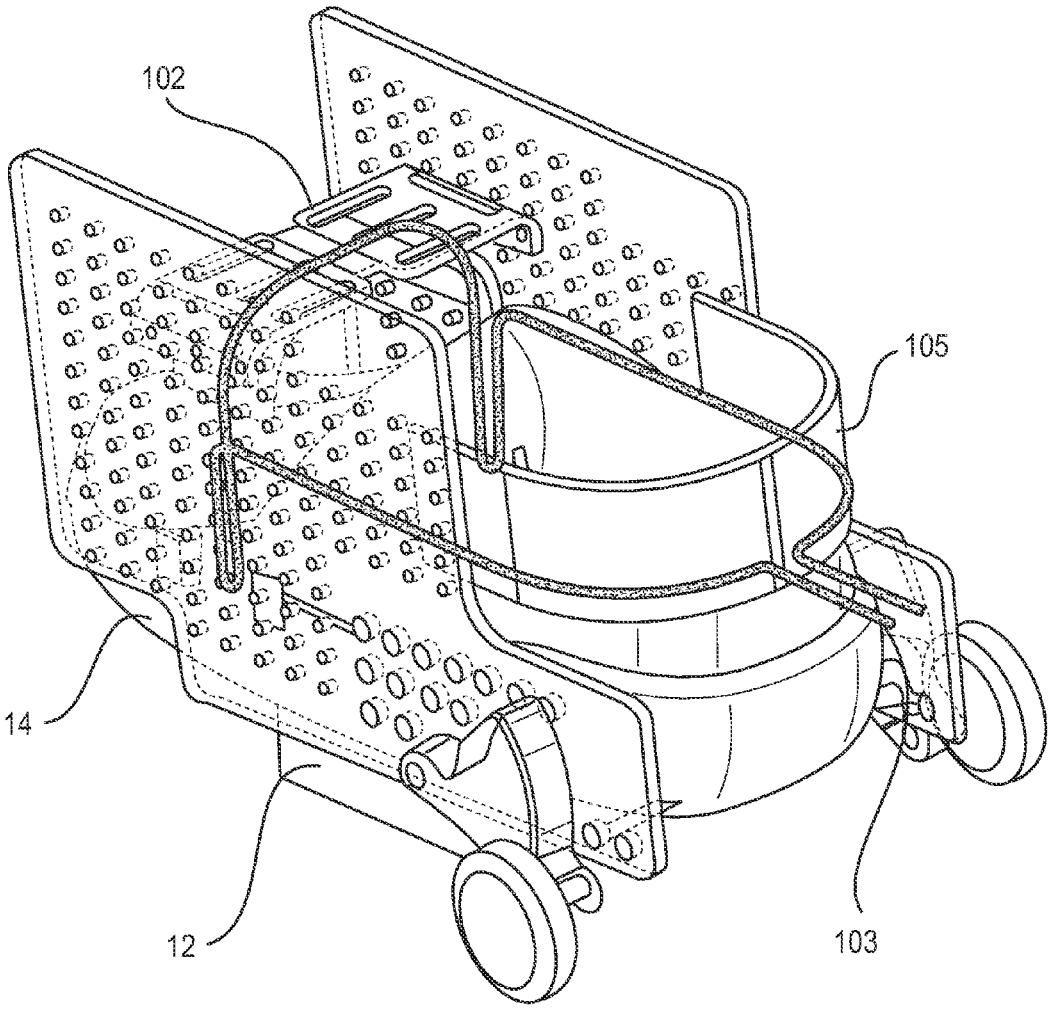
Figure 2F:
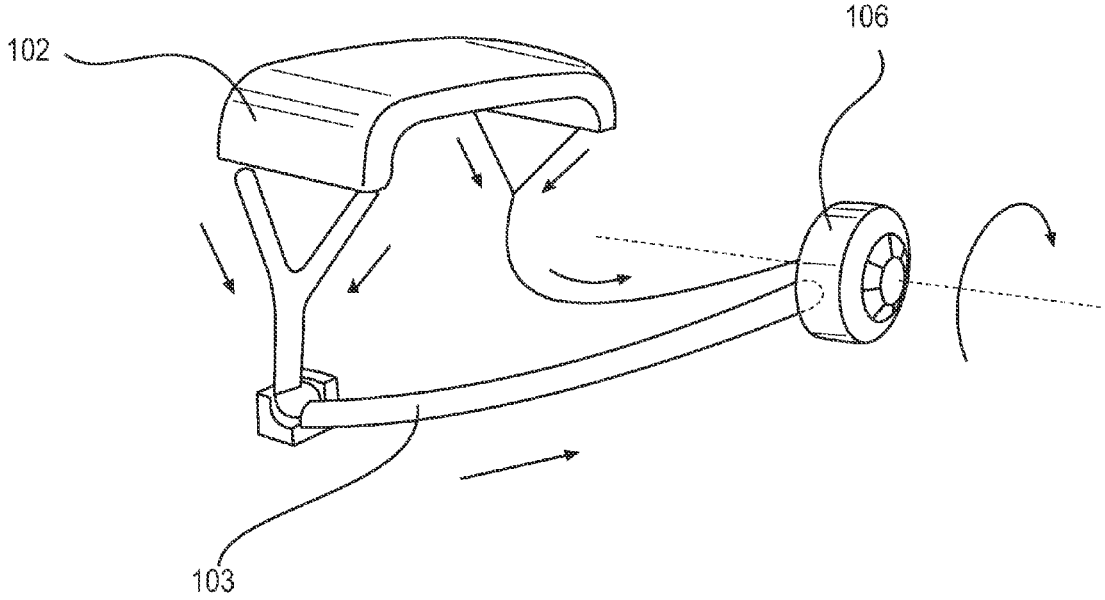

FIG. 2D illustrates another exemplary locking mechanism 110 including a forefoot cross member 102, a cable system 103, a heel support member 105, and an adjustment button 106. As further illustrated in FIG. 2E (wheel assemblies 16 and 18 are omitted for ease of illustration), cable system 103 connects cross member 102 and heel support member 105. As further shown in FIG. 2F, cable system 103 may be adjusted by turning button 106. When button 106 is turned, for example, clockwise, cable system 103 may be tightened, pulling cross member 102 and heel support member 105 against the user's shoe 14. As a result, the user's shoe 14 is secured to base 12 by cross member 102 and heel support member 105. The button 106 may have a release mechanism that can release cable system 103 when the release mechanism is pressed.

Figure 2G:
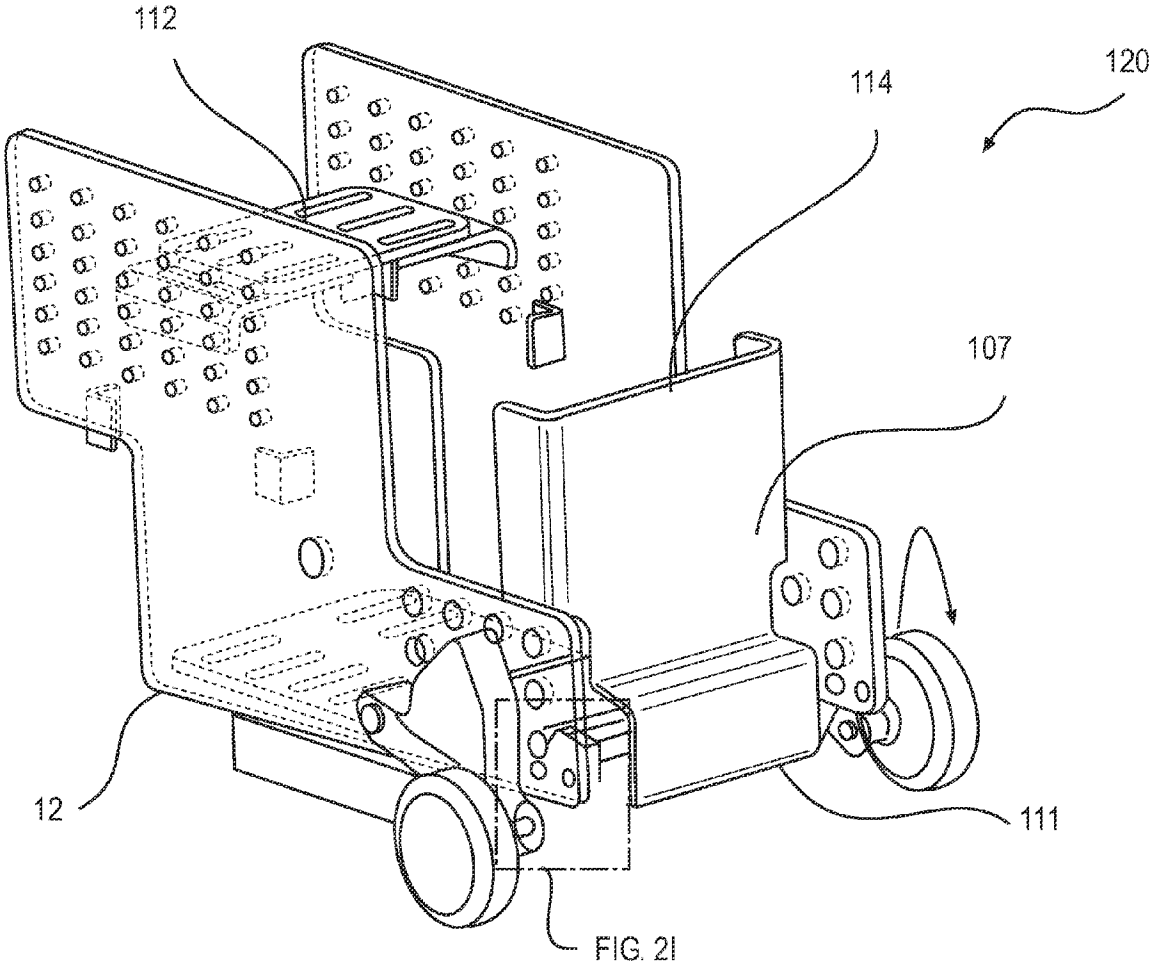
FIGS. 2G and 2H illustrate an exemplary step-in locking mechanism for securing the shoe of the user to the motorized transportation device.
Figure 2H:
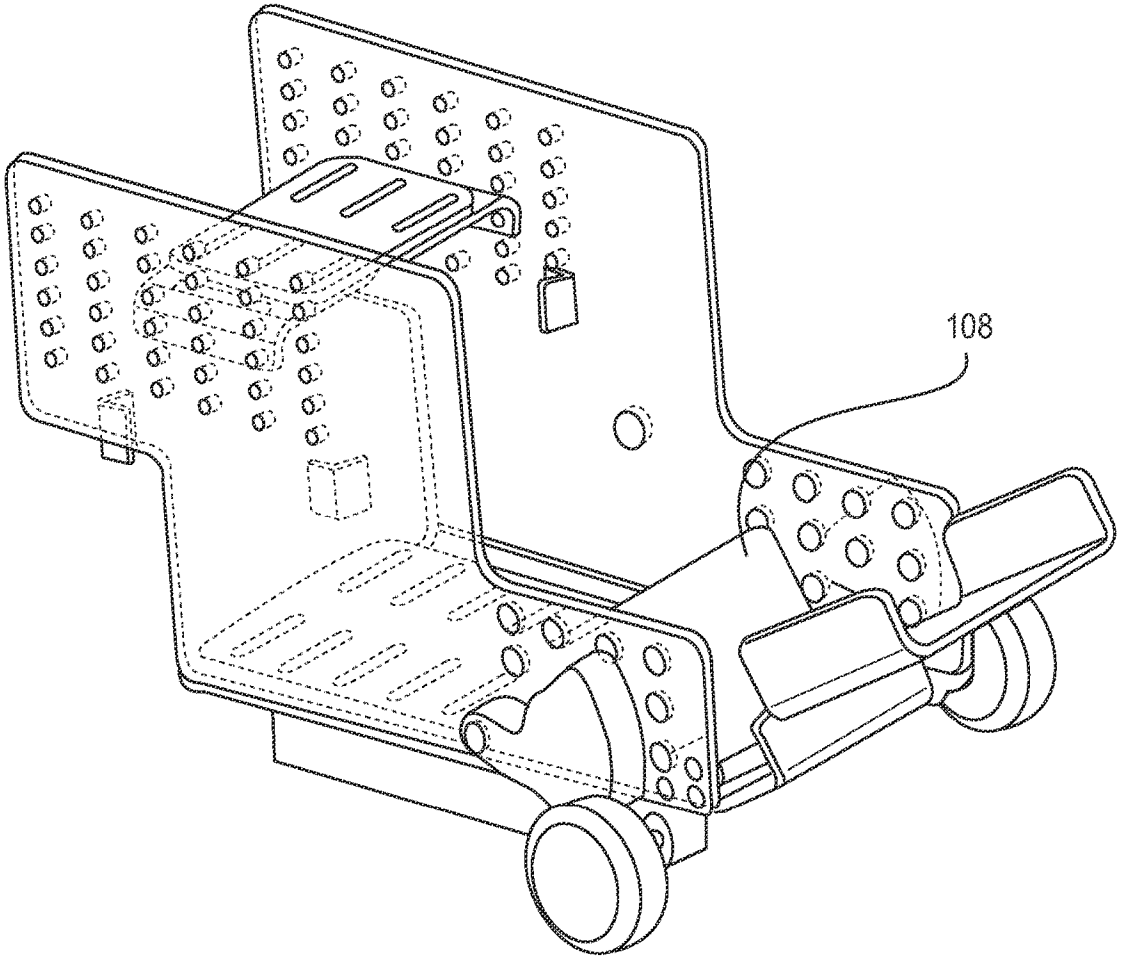

In some embodiments, as shown in FIGS. 2G and 2H (wheel assemblies 16 and 18 are omitted for ease of illustration), base 12 may include a step-in locking mechanism 120 that allows the user to step into base 12 to trigger locking mechanism 120. As shown in FIG. 2G, step-in locking mechanism 120 includes a forefoot cross member 112 and a heel support member 107. Heel support member 107 has a first end portion 111 coupled to a rear portion of base 12 through a shaft 113 and pivots on shaft 113. Heel support member 107 has a second end portion 114 that may be made to conform to a shape of the user's heel. First end portion 111 of heels support member 107 may further include a tab 108 extending inward and forming an angle with first end section 111. The user may activate locking mechanism 120 by sliding shoe 14 into base 12 and stepping onto tab 108. Upon activation, heel support member 107 pivots from an opening position (FIG. 2H) to a closed position (FIG. 2G) and presses against a heel portion of the user's shoe 14. On the other hand, forefoot cross member 112 prevents the user's shoe 14 from moving forwards and upwards. As a result, locking mechanism 120 secures the user's shoe 14 to base 12.

Figure 2I:
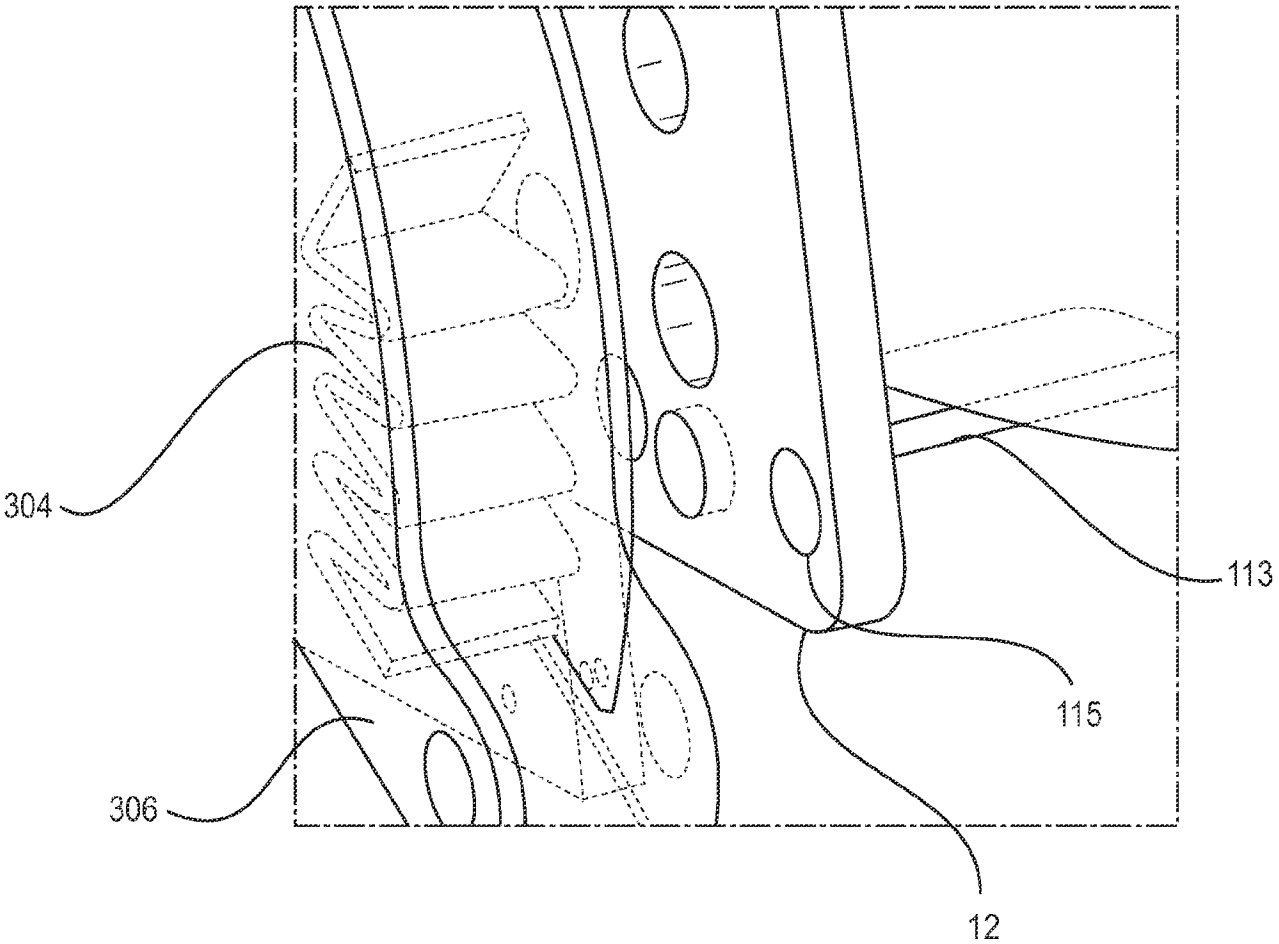
FIGS. 2I and 2J illustrate an exemplary adjustable heel support member for the step-in locking mechanism.
Figure 2J:
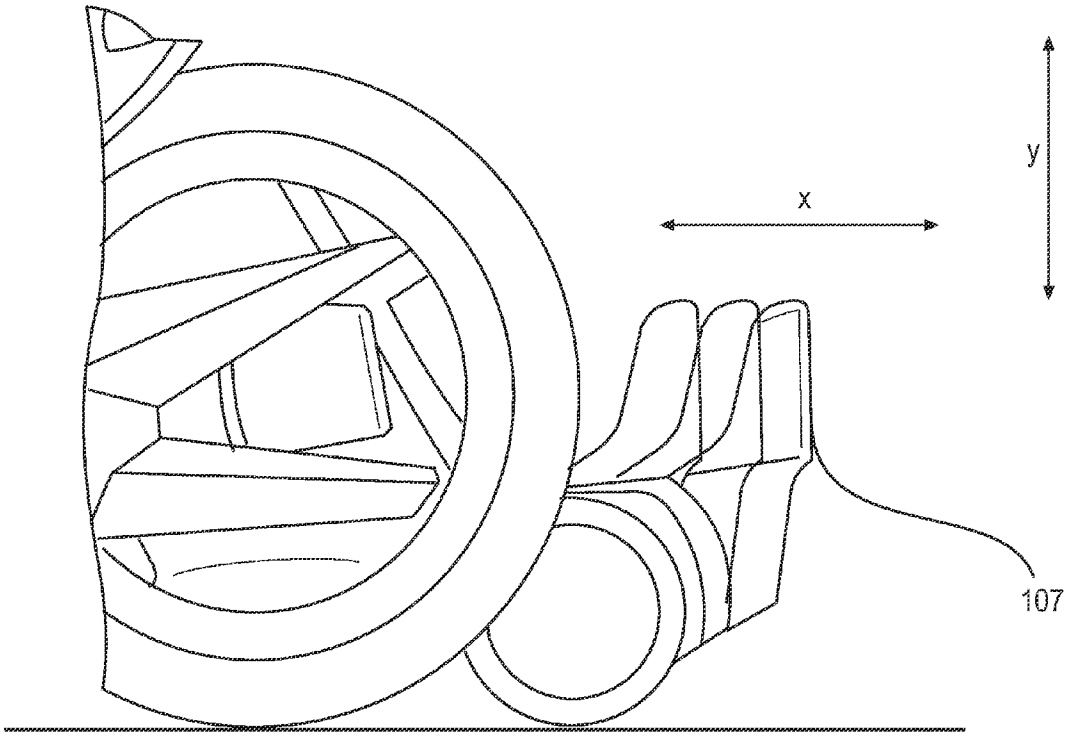

According to a further embodiment as shown in FIGS. 2I and 2J, the location of heel support member 107 with respect to base 12 may be adjusted as desired or according to the size of the user's shoe 14. For example, base 12 may have a plurality of sets of holes 115 that allow shaft 113 to be adjusted with respect to base 12. Heel support member 107 may be adjusted in the vertical direction as well as the horizontal direction by placing shaft 113 into different holes accordingly. For example, as further shown in FIG. 2J, heel support member 107 may be adjusted according to the size of the user's shoe 14 by moving shaft 113 in the x direction and/or the y direction.

According to a still further embodiment, the locking mechanisms illustrated in FIGS. 2B-2J may be combined. For example, the step-in locking mechanism may be used to activate to initially attach device 10 to the user's shoe 14, while the cable system may be used to further secure device 10 to the user's shoe 14.

Figure 3A:
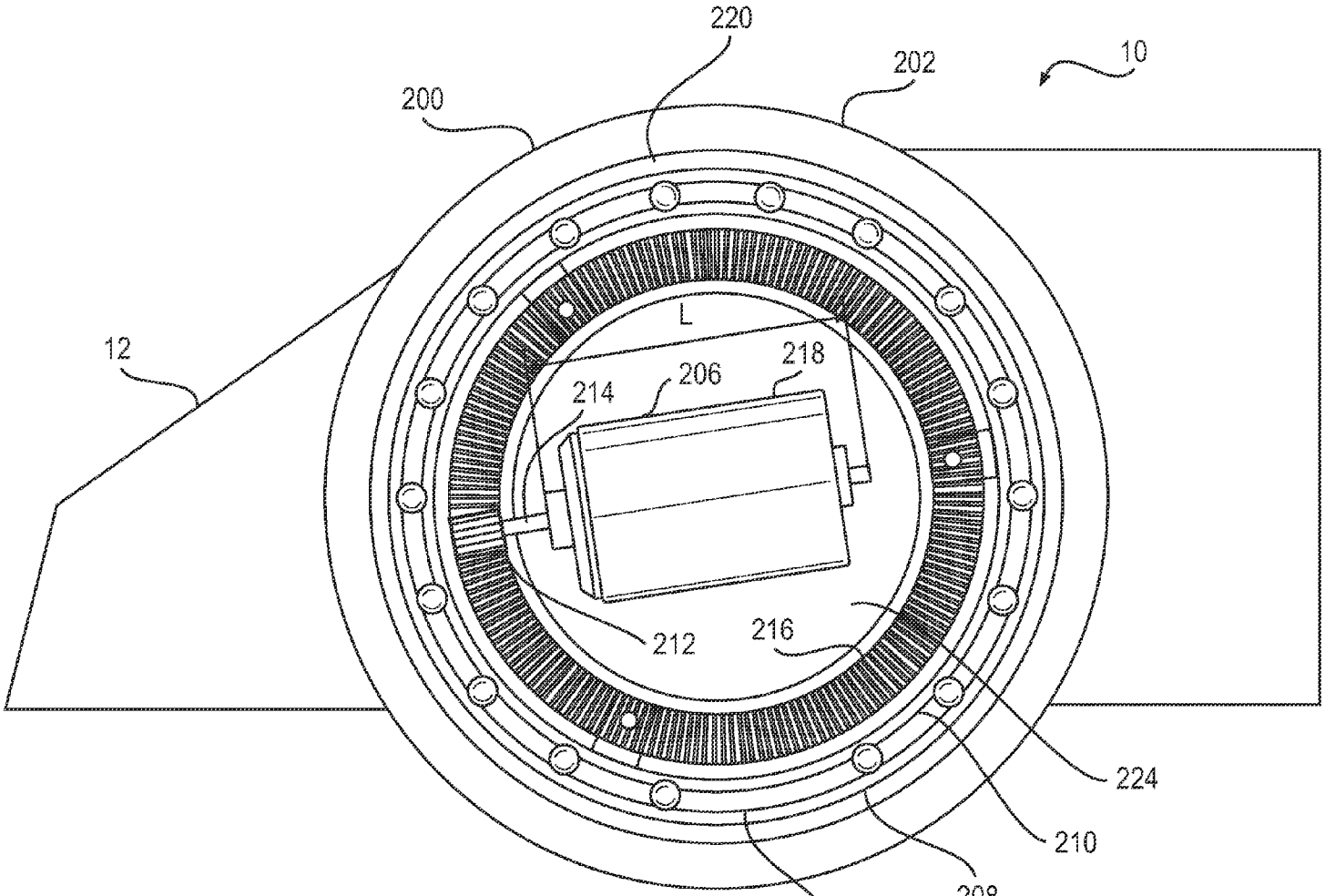
FIG. 3A is a view of a wheel assembly of the motorized transportation device according to one embodiment.

FIG. 3A illustrates an exemplary wheel assembly 200 for motorized transportation device 10 according to an embodiment. Wheel assembly 200 generally corresponds to wheel assembly 16, wheel assembly 18, or both, as shown in FIGS. 1 and 2. Wheel assembly 200 includes a rim 220, a tire 202 mounted on an exterior of rim 220, a ring gear 216 mounted on an interior of rim 220, and an electrical motor 206 disposed within an opening 224 of ring gear 216. Tire 202 and rim 220 form a wheel, which is aligned with the ring gear 216 so that they are coaxial. Alternatively, ring gear 216 may be formed on rim 220 or as a part of rim 220.

Motor 206 includes a rotatable shaft or axle 214 and a gear 212 disposed at a distal end of axle 214. Gears 212 and 216 are engaged and in mesh. Accordingly, when motor 206 is supplied with electrical power, gear 212 is rotated by axle 214, driving ring gear 216 to rotate. Gears 212 and 216 form a transmission assembly configured to transmit a rotational motion of axle 214 to a rotational motion of ring gear 216. Rim 220 and tire 202 are fixed with ring gear 216 and rotate together with ring gear 216. Gears 212 and 216 are chosen to provide a desired gear ratio between motor 206 and ring gear 216.

According to a further embodiment, gears 212 and 216 are bevel gears. In some embodiments, when gears 212 and 216 are engaged and in mesh, shaft 214 of motor 206 extends in a radial direction of wheel assembly 200. A person having ordinary skill in the art should appreciate that gears 212 and 216 may be other types of gears, such as spiral bevel gears, hypoid gears, planetary gears, etc. A person having ordinary skill in the art should appreciate that employing other types of gears may allow or require structure variations. For example, if hypoid gears are used, the axes of the two gears may not intersect. In other words, the shaft 214 may not extend in a radial direction of the gear 216. In addition, a person having ordinary skill in the art should appreciate that other designs or arrangements of gear sets (such as using more than two gears) may be used to achieve the same functionalities and results. Those are choices of designs and are encompassed by the present disclosure.

In some embodiments, gears 212 and 216 may be angled. A person having ordinary skill in the art should appreciate that each gear may be formed with a pitch angle. The axes of gears 212 and 216 may be perpendicular to each other. In some other embodiments, the axes of gears 212 and 216 may not be perpendicular to each other.

Motor 206 may be a DC motor, which receives DC electrical power from an electrical power source, such as a battery pack on-board transportation device 10. The battery pack (406 in FIG. 4) may be mounted on or within heel support member 105 (see FIG. 2E or 107 in FIG. 2G). The battery pack may be shaped to conform to a shape of a user's heel. Alternatively, the battery pack may be in the forefoot cross member 102. As shown in FIG. 2D, the forefoot cross member 102 (with the battery pack) may be shaped to conform to a user's forefoot. The forefoot cross member 102 may have cushions on its bottom surface that will be in contact with the user's shoe or foot. The battery pack may be removable, and can be exchanged. The batteries within the battery pack may be rechargeable.

Motor 206 has a housing 218 with a length L that is sufficiently small so that motor 206 may be disposed within the opening 224 of ring gear 216 without interfering with the motion of ring gear 216. Housing 218 of motor 206 may be mounted to base 12 of transportation device 10.

Additionally, wheel assembly 200 may further include a bearing 204 coupled with rim 220. Bearing 204 may be a rolling-element bearing, such as a ball bearing or a roller bearing, including an outer race 208 and an inner race 210 that are rotatable with respect to each other. Bearing 204 may be mounted on rim 220 through one of outer race 208 or inner race 210. The other one of outer race 208 or inner race 210 may be mounted to base 12 of transportation device 10. Thus, bearing 204 provides a rotatable coupling between rim 220 and base 12. When motor 206 drives ring gear 216 to rotate, rim 220 and tire 202 may be rotated with respect to base 12, thereby driving transportation device 10. As shown in FIG. 3A, the bearing 204 may be mounted on rim 220, outside of ring gear 212, but inside of an outer circumference of rim 220 or tire 202.

Figure 5B:
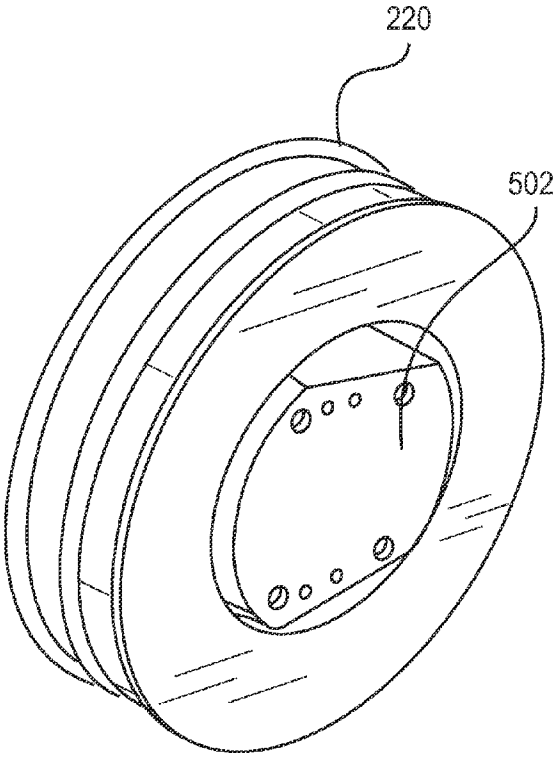
FIGS. 5A and 5B illustrate perspective views of a rim and a bearing mounted thereon according to one embodiment.
Figure 5A:
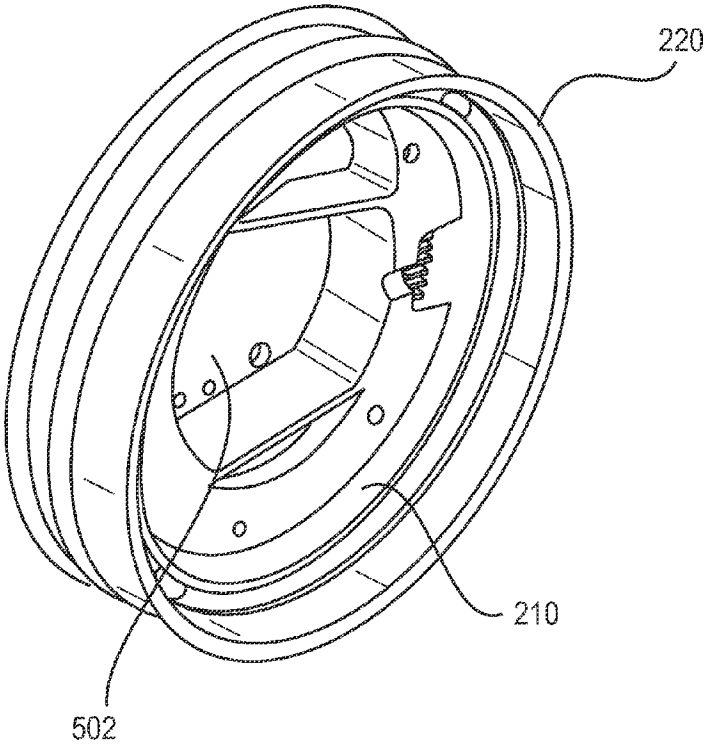
Figure 6B:
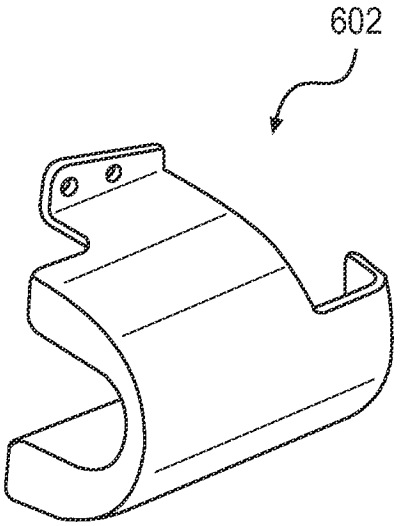
FIGS. 6A and 6B illustrate perspective views of a motor cover for mounting a motor according to one embodiment.
Figure 6A:
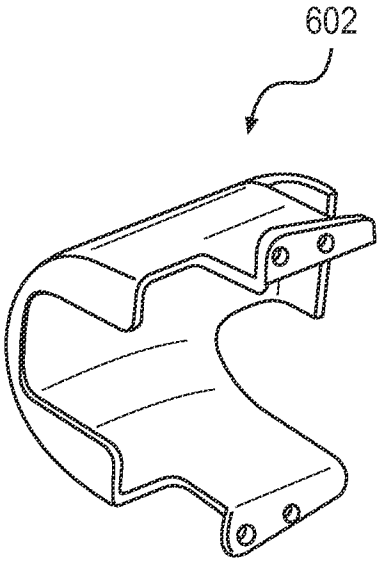

According to a further embodiment as shown in FIGS. 5A and 5B, inner race 210 of bearing 204 has a support structure 502 for coupling with base 12. Support structure 502 includes through holes and may be attached to base 12 by screws or bolts passing through the through holes. Support structure 502 may include additional screw holes for securing motor 206. Motor 206 may be attached to support structure 502 by a motor bracket or motor cover 602 as shown in FIGS. 6A and 6B. Motor cover 602 may be secured to support structure 502 by screws or bolts received by the screw holes.

According to an alternative embodiment, motor cover 602 may be secured to support structure 502 via a snap-in mechanism or other mechanical means, such as welding or gluing. According to another embodiment, motor 206 may be attached to support structure 502 through motor housing 218. As a result, motor cover 602 may be omitted. According to still another embodiment, support structure 502 may be provided by base 12 or other structures of device 10.

In this embodiment, outer race 208 of bearing 204 is mounted to rim 220 or formed as a part of rim 220. When motor 206 drives rim 220 through gears 212 and 216, rim 220 and outer race 208 rotate with respect to motor 206 and inner race 210, thereby driving transportation device 10 to move.

Figure 7B:
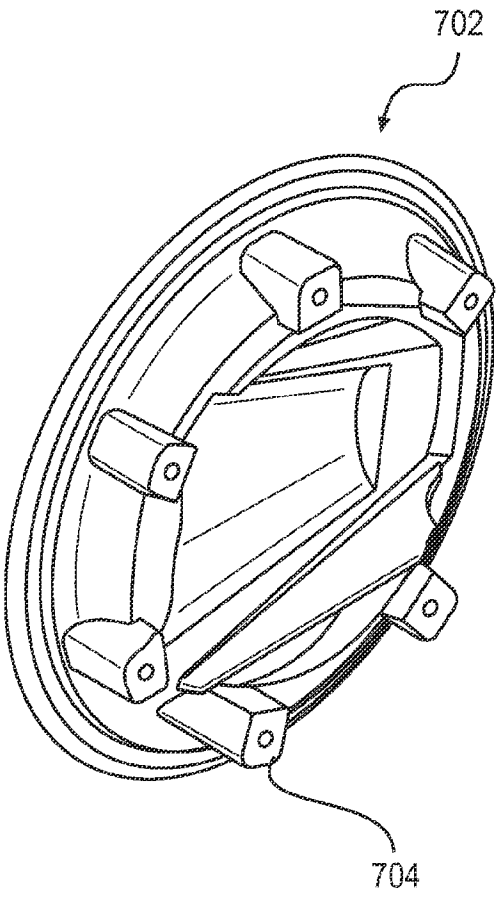
FIGS. 7A and 7B illustrate perspective views of a wheel cover according to one embodiment.
Figure 7A:
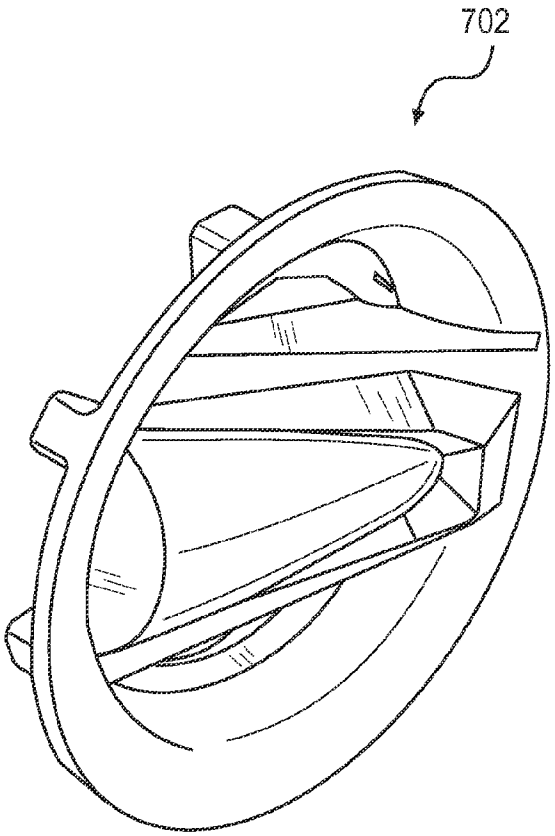

FIGS. 7A and 7B illustrate perspective views of a wheel cover 702. Wheel cover 702 may be mounted to support structure 502 or inner race 210 through holes 704. In addition, sealant or seals may be applied between wheel cover 702 and support structure 502 or inner race 210 to block moisture or dirt.

According to a further embodiment, wheel assemblies 16 and 18 may each include a quick release mechanism. The quick release mechanism include, for example, a coupling between base 12 and one of race 208 or 210 that may be engaged or disengaged by the user. The quick release mechanism allows removal of the wheel assemblies without tools for easy assembling, transportation, and shipping.

According to a further embodiment, wheel assemblies 16 and 18 may each be coupled to base 12 through a suspension. The suspension may allow the user's ankle to rotate while maintaining the contacts between the traveled surface and wheel assemblies 16 and 18. In one embodiment, the suspension may be a passive suspension such that, when the user leans laterally, the suspension may cause base 12 to tilt towards left or right accordingly. In another embodiment, the suspension may include an active component that may automatically cause base 12 to tilt towards left or right according to, for example, a slope of the traveled surface. Alternatively, the active component may allow the user to control the tilting of base 12 to left or right as desired. In a further embodiment, the suspension may be provided by tire 202, which may be an airless tire.

According to a further embodiment, wheel assembly 200 has a size (e.g., diameter and width) suitable for transportation device 10 that is wearable by the user, e.g., on foot. The size and weight of wheel assembly 200 can provide adequate ground clearance between base 12 and the traveled surface. According to a still further embodiment, wheel assembly 220 has a diameter of 5-7 inches, for example, 165 mm (6.5 inches). The wheel assembly 220 may be smaller, for example, for kids' size. The size of wheel assembly 200 may vary according to the size of the component disposed therein and other factors, such as conditions of the traveled surface and the needs of the user.

Figure 3C:
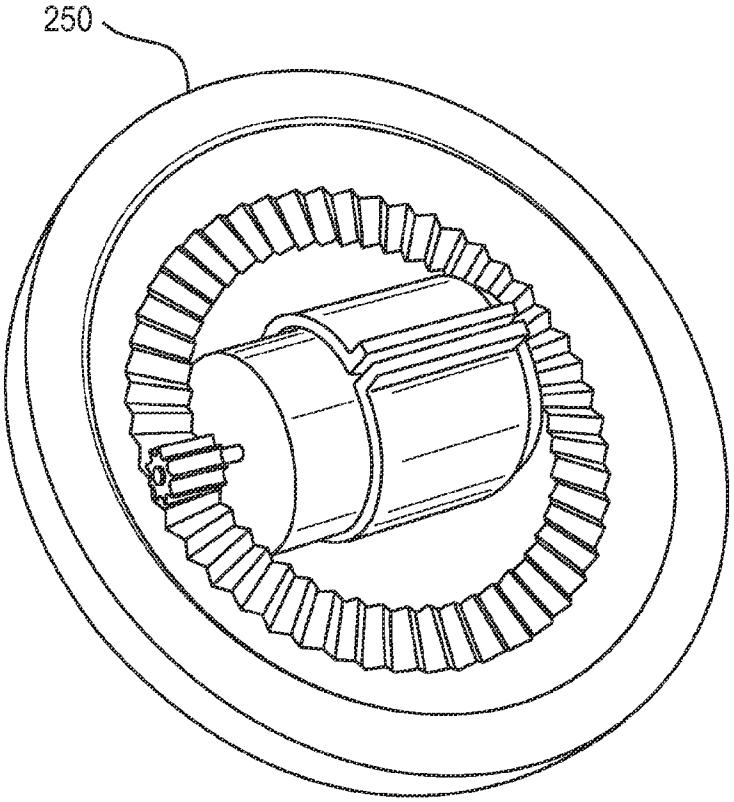
FIGS. 3B and 3C depict another embodiment of the wheel assembly of the motorized transportation device.
Figure 3B:
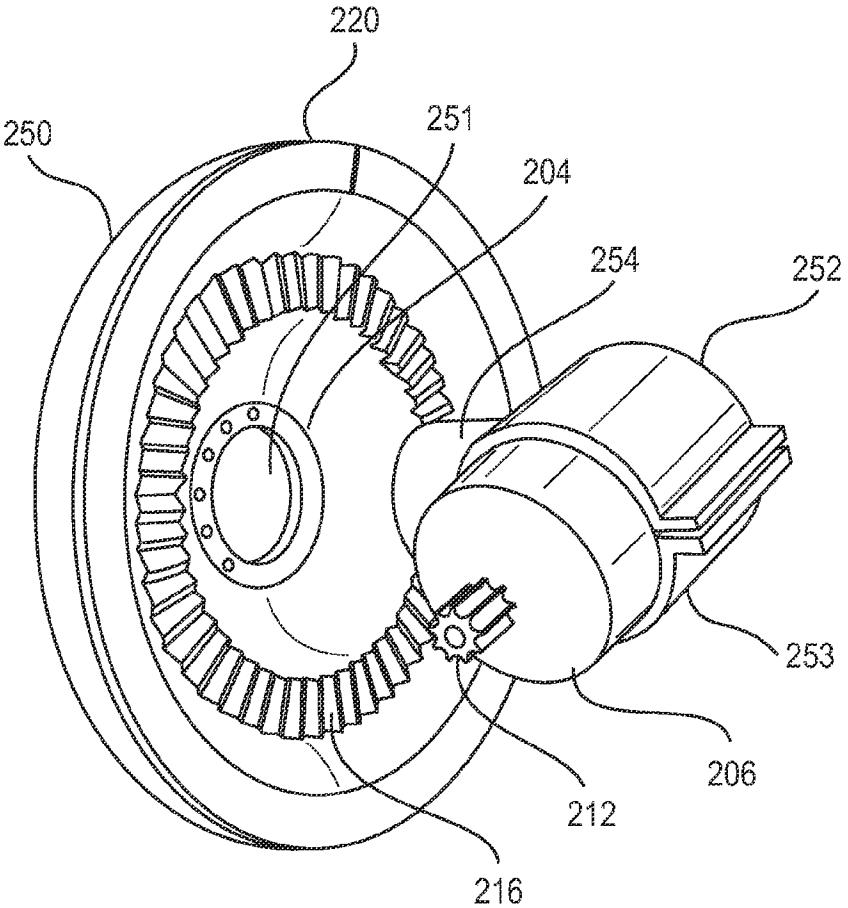

FIGS. 3B and 3C illustrate another exemplary wheel assembly 250, which generally corresponds to wheel assemblies 16 and 18 of FIG. 1. In wheel assembly 250, the inner race of bearing 204 may have an opening 251. Motor 206 is coupled to base 12 via a motor bracket 252. Motor bracket 252 includes a motor housing 253 that receives and secures motor 206 therein and a mounting section 254 that may be inserted into opening 251 of bearing 204. Mounting section 254 may be mounted to the inner race of bearing 204 through interference fit or other devices. Mounting section 254 may further include a tunnel made in the axial direction thereof for passing control and power lines to motor 206.

Wheel assembly 250 further includes a rim 220 mounted on an outer race of bearing 204. A bevel gear 216 is mounted on rim 220, while another bevel gear 212 is mounted on an end of a shaft 214 of motor 206. The rim 220, bevel gear 216, and the wheel are concentric. The shaft 214 of the motor 206 extends in a radial direction of the bevel gear 216. Gears 212 and 216 are engaged, when motor 206 is fully installed and secured by motor bracket 252 to base 12 (FIG. 3C). As a result, when motor 206 drives rim 220 to rotate, rim 220 may rotate with respect to base 12, thereby moving device 10. As shown in FIGS. 3A-3C, the motor 206, its housing 253, and motor bracket 252 are all fit in the inner diameter of gear 216.

Figure 4:
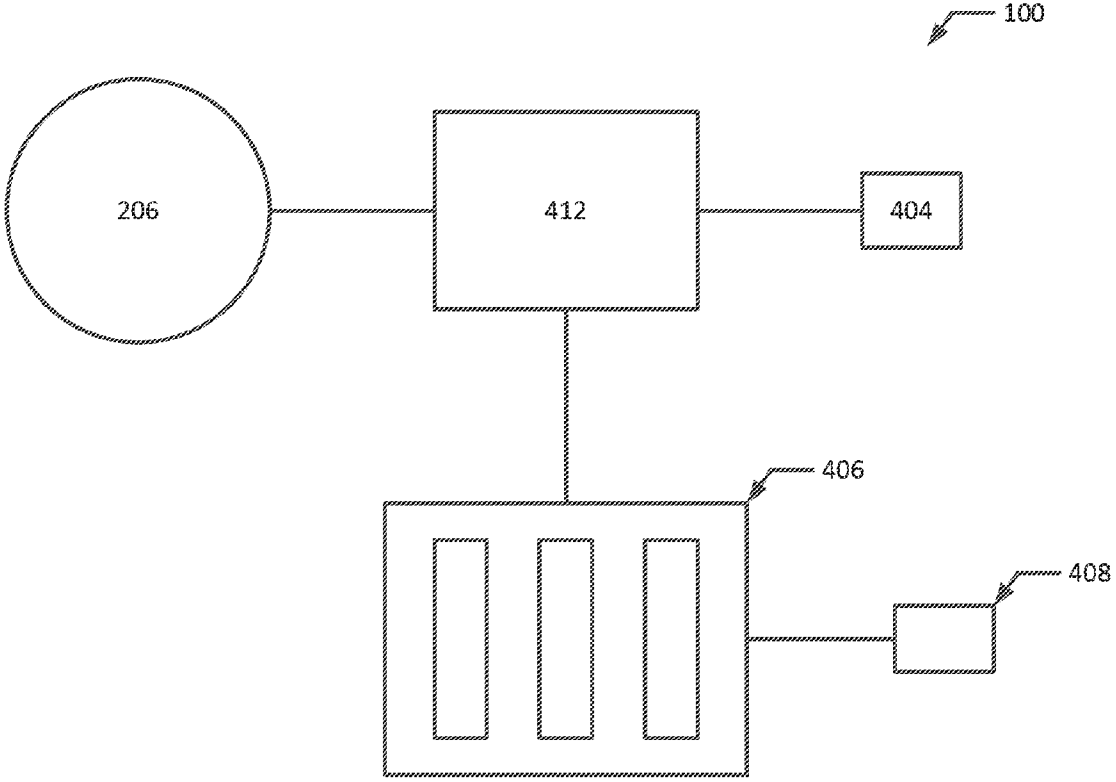
FIG. 4 is a schematic diagram of a control system of the motorized transportation device.

FIG. 4 illustrates a schematic circuit diagram for a control system 100 of motorized transportation device 10, according to one embodiment. Control system 100 may be used to control individual motor 206 integrated within wheel assembly 200 shown in FIG. 3A.

Specifically, control system 100 includes one or more sensors 404, a battery pack 406 including a plurality of battery cells connected in a series/parallel configuration, a battery charging port 408, and the controller 412. Controller 412 may include a computer-readable medium, such as a memory, for storing computer codes and processor for executing the computer codes. The processor may cause controller 412 to receive signals from sensor 404 and generate commands to control motor 206.

Sensors 404 are coupled to controller 412. As discussed above, sensors 404 can detect instructions from the user or motions and gestures provided by the user. For example, sensors 404 may detect the user leaning forward and generate signals accordingly instructing device 10 to accelerate. Sensors 404 may also detect the user leaning backward and generate signals accordingly, instructing device 10 to decelerate. Sensors 404 may also detect the user standing balanced and generate signals accordingly, instructing device 10 to maintain the current speed. A person having ordinary skills in the art can configure other control instructions upon studying the disclosure.

Sensors 404 transmit the signals, generated according to the detected instructions, motions, and/or gestures, to controller 412 for controlling and operating motor 206. Controller 412 controls the speed of rotation of motor 206 and the direction of travel (i.e., forward or backward) of the transportation device 10 according to the received control signals.

Battery pack 406 may be charged by external power sources through battery charging port 408. Battery pack 406 may include an indicator, such as a LED device or a display screen, for indicating various status of battery pack 406, such as charging, fully charged, low power, etc.

By incorporating motor 206 in wheel assembly 200 or 250, wheel assembly 200 forms a compact structure that may be easily installed, replaced, and serviced. Because motor 206 does not take up spaces within base 12, base 12 and the entire transportation device 10 may be made relatively more compact and light, saving materials and costs.

According to a further embodiment as shown in FIG. 2D, device 10 may include one or more additional wheel assemblies, such as a wheel assembly 308. Wheel assembly 308 may be coupled to, for example, a rear section of base 12 through a suspension 306. Wheel assembly 308 provides additional supports to assist a user to balance when the user uses device 10. FIG. 2I further depicts a see-through view of suspension 306 including a spring element 304 or other energy absorption means disposed within suspension 306. Spring element 304 connects wheel assembly 308 with base 12, thereby reducing shocks and impacts from the traveled surface and maintaining a contact between wheel assembly 308 and the traveled surface.

According to an alternative embodiment, a pressure sensor may be integrated with suspension 306 to generate a pressure signal according to a pressure applied on suspension 306 by the user. Motor controller 412 may receive the pressure signal and determine a change in the pressure on suspension 306 according to the pressure signal. For example, when the user leans forward, motor controller 412 may detect a decrease in the pressure on suspension 306. When the user leans backward, motor controller 412 may detect an increase in the pressure on suspension 306. According this change in the pressure, motor controller 412 may control device 10 to accelerate or decelerate, or move forward or backward.

Alternatively, the rear wheel assembly 308 including the suspension 306 may include a switch to control the movement of the device. For example, when the suspension is pressed to a certain point, it turns on a switch and the device can start to move. Different degrees of compression of the suspension may turn on different switches corresponding to different speed levels of the device. One degree of the compression may correspond to stopping the motor and/or breaking the wheels.

According to a further embodiment, a plurality of ring gears may be mounted to rim 220 shown in FIG. 3A. The ring gears may be arranged concentrically on rim 220. Motor 206 may be adjusted so that gear 212 is engaged with any one of the ring gears as desired. Different ring gears may provide different gear ratios for the transmission assembly and thus provide different dynamics for driving device 10. Alternatively, a plurality of gears similar to gears 212 may be disposed on shaft 214 of motor 206. The motor 206 may be adjusted so that any one of the gears on shaft 214 may be engaged with ring gear 216.

Still alternatively, the gears 212 and 216 may be replaced by a gear box coupled between motor 206 and rim 220. The gear box may include an input shaft coupled to motor 206 for receiving a rotational input therefrom and an output shaft coupled to rim 220 for driving rim 220 to rotate. The gear box may further include a plurality of gears that allow the user to adjust the gear ratio by selecting different gears.

According to a still alternative embodiment, the transmission assembly between motor 206 and rim 220 may include a friction transmission means for transmitting the rotational motion from motor 206 to rim 220 by way of friction. The friction transmission means may include a friction disc mounted on rim 220 and a roller mounted on shaft 214 of motor 206. The roller, when driven by shaft 214, causes the friction disc and rim 220 to rotate by way of friction.

According to another embodiment, wheel assemblies 16 and 18 may be the tank-track style assemblies. For example, each wheel assembly may include a plurality of wheels driving a metal or rubber track. The wheels may be embedded within the wheel assemblies and driven by a motor. Upon reading this disclosure, one of ordinary skill in the art will recognize that other variations of wheel assemblies 16 and 18 may be implemented to drive device 10 using motor 206.

FIGS. 8-14 show alternatively embodiments of wheel assembly (i.e., wheel assemblies 16 and 18 of FIG. 1) for motorized transportation device 10.

Figure 8:
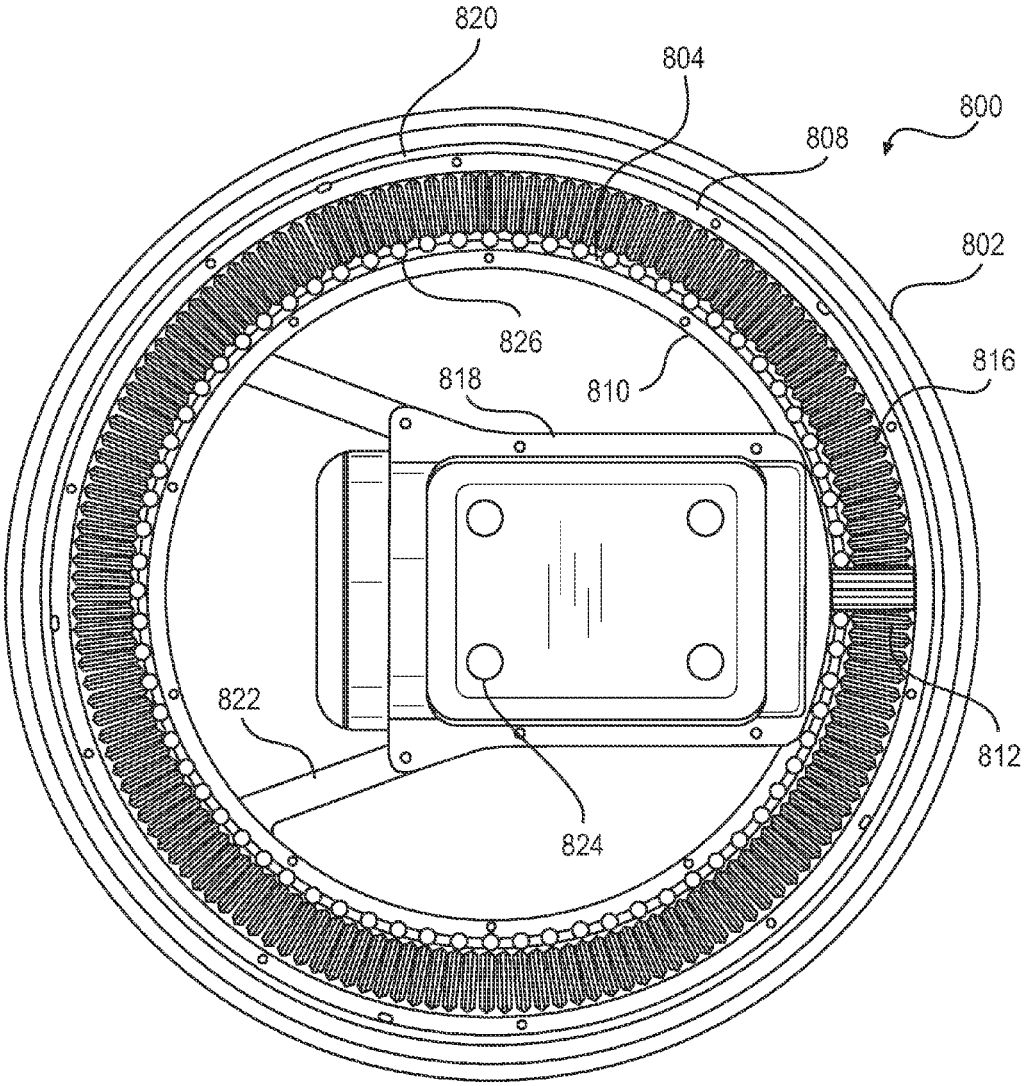
FIG. 8 shows a perspective view of a wheel assembly with the motorized transportation device according to one embodiment.
Figure 9:
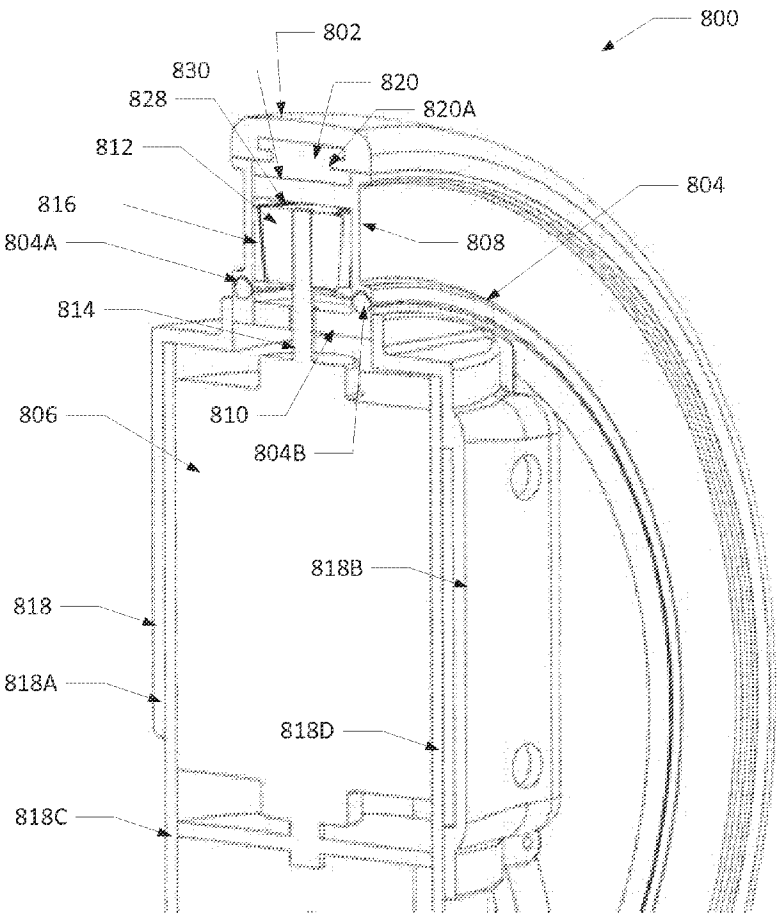
FIG. 9 shows a partial cross-sectional view of the wheel assembly with the motorized transportation device according to one embodiment.
Figure 10:
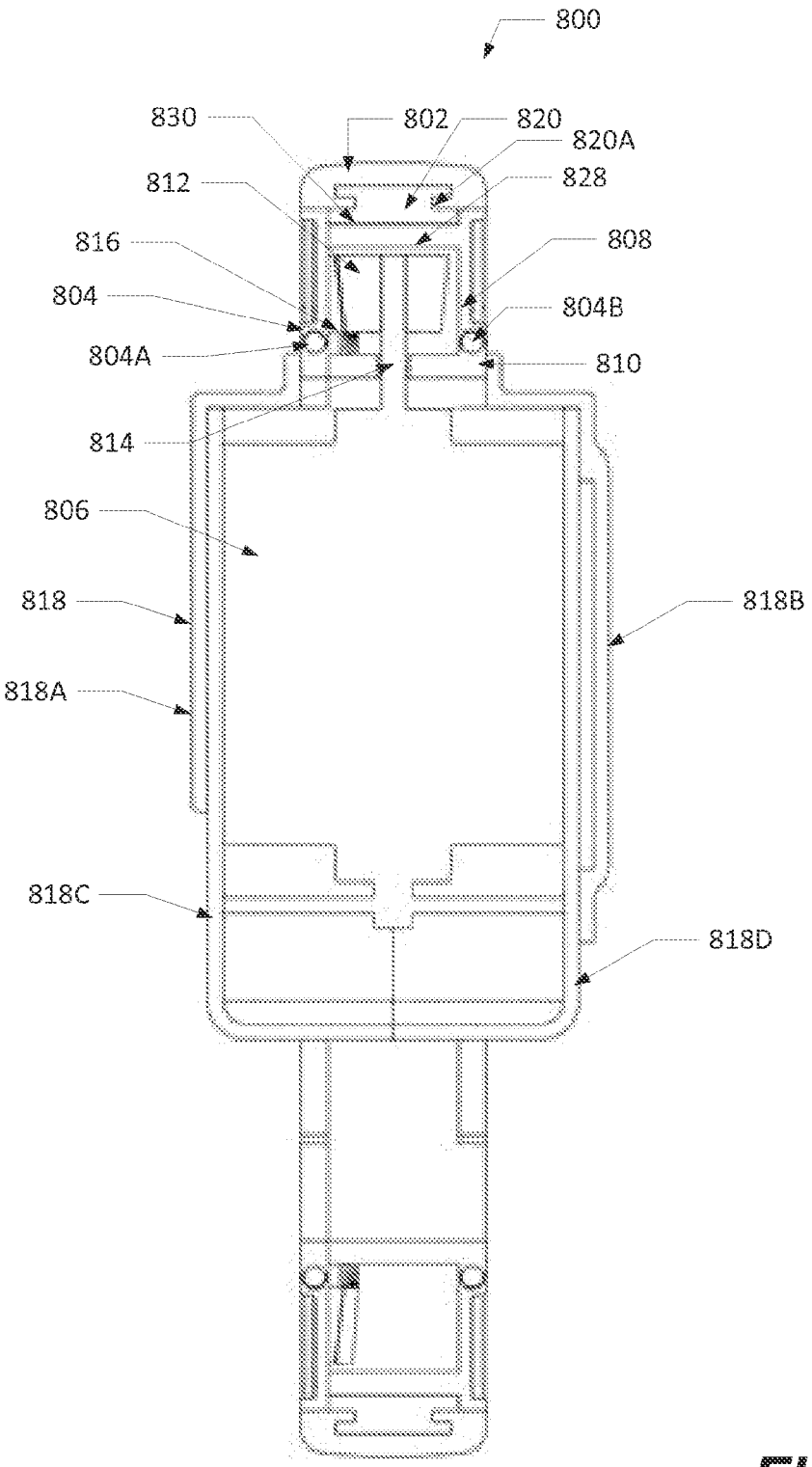
FIG. 10 shows a cross-sectional view of the wheel assembly with the motorized transportation device according to one embodiment.

For example, FIGS. 8-10 show an exemplary wheel assembly 800 in its assembled state, which may be implemented for device 10, according to an embodiment. Wheel assembly 800 includes a wheel having a tire 802, a bearing 804, and a motor 806. Wheel assembly 800 further includes a transmission assembly having a drive gear 812 and a ring gear 816. Bearing 804 includes a circular outer race 808 and a circular inner race 810. FIG. 8 shows wheel assembly 800 with outer race 808 of bearing 804 rendered in transparency to show ring gear 816 and drive gear 812. FIG. 9 shows a partial cross-sectional view of wheel assembly 800. FIG. 10 shows an additional cross-sectional view of wheel assembly 800.

Outer race 808 includes one or more grooves along its inner rim. Inner race 810 includes one or more grooves along its outer rim that correspond to the grooves of inner race 810. When outer race 808 and inner race 810 are coupled with each other, the corresponding grooves thereof form one or more circular channels 804A and 804B running along the circumferential direction of bearing 804. A plurality of rolling elements 826 may be disposed within circular channels 804A and 804B, so that outer race 808 and inner race 810 may be rotated with respect to each other. Rolling elements 826 may be balls, needles, cylindrical pins, conical pins, and the like. Although FIGS. 9 and 10 show two circular channels 804A and 804B in bearing 804, a person of ordinary skill in the art would appreciate that any numbers of channels may be formed in bearing 804 without departure from the principle of this disclosure.

In an alternative embodiment, rolling elements 826 may be omitted so that outer race 808 and inner race 810 of bearing 804 have a direct contact with each other. A lubricant may be applied between outer race 808 and inner race 810 so that to reduce friction.

In an embodiment, bearing 804 includes various structural features, through which other components are assembled to form wheel assembly 800. For example, outer rim of outer race 808 includes a mounting surface 830 for mounting circular rim 820. Mounting surface 830 may include a groove in the circumferential direction of wheel assembly 800 for receiving and securing rim 820. Alternatively, rim 820 may be mounted on outer race 808 through interference fit.

Rim 820 may include surface features for receiving and securing tire 802. For example, rim 820 may have grooves or cutouts 820A on its side surfaces, which receive corresponding protruding elements of tire 802. Tire 802 may be made of an elastic material, such as rubber or plastic. Tire 802 may be mounted on rim 820 by temporarily deforming portions of tire 802 so as to place the protruding elements into grooves 820A. In an alternative embodiment, rim 820 may be omitted, so that tire 802 may be directly mounted on outer race 808. Outer race 808 may have features similar to those of rim 820 for receiving and securing tire 802.

Returning to bearing 804, outer race 808 and inner race 810 may further form a circular cavity 828 in the circumferential direction. Ring gear 816 may be disposed on an inner surface of cavity 828. Drive gear 812, which is coupled to motor 806 through shaft 814 and supported by shaft 814, is disposed within cavity 828 and meshed with ring gear 816. Shaft 814 extends in a radial direction of wheel assembly 800 and protrudes through an opening of inner race 810, so that a rotational motion of shaft 814 is transmitted to a rotational motion of wheel assembly 800. Circular cavity 828 forms an enclosed space to keep out dirt, water, and moisture and prevent lubricant from leaking out, thereby protecting the gears therein.

Figure 11:
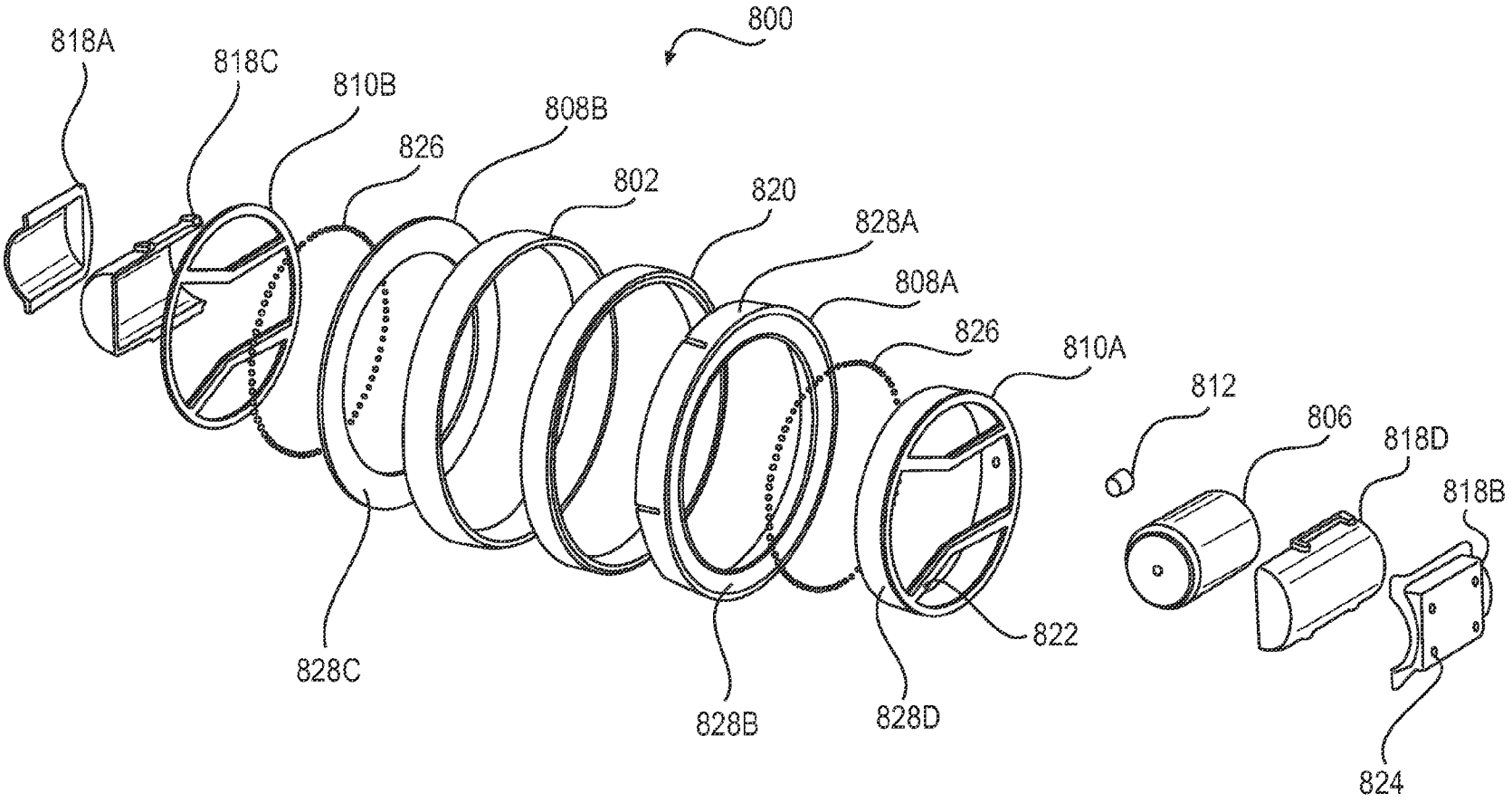
FIG. 11 is an exploded view of the wheel assembly with the motorized transportation device according to one embodiment.

As further shown in FIGS. 8-11, inner race 810 of bearing 804 includes frames or struts 822 for securing motor 806. FIG. 11 shows an exploded view of wheel assembly 800, in which the components are rendered in their assembly order. Motor 806 may be disposed within motoring housing 818 and affixed to frames 822 through motor housing 818. Motor housing 818 may include an upper housing formed by housing elements 818A and 818B, and a lower housing formed by housing elements 818C and 818D. Housing elements may be secured or affixed to frames 822 through screws or rivets.

In an embodiment, the upper housing formed by elements 818A and 818B and the lower housing form by elements 818C and 818D each have a substantially cylindrical shape with a cylindrical opening. The inner diameter of the upper housing is slightly greater than the outer diameter of the lower housing. Motor 806 may be disposed within the cylindrical opening of the lower housing and secured therein by screws or interference fit. The lower housing, with motor 806 disposed therein, may be partially disposed with the cylindrical opening of the upper housing. In an alternative embodiment, motor 806 may be disposed and affixed within the upper housing, which is then partially disposed within the lower housing.

In a further embodiment as shown in FIGS. 8 and 11, motor housing 818 may have an attaching mechanism 824 for attaching the wheel assembly 800 to base 12 of device 10. Attaching mechanism 824 may include through holes disposed on a flat portion of housing 818. The flat portion of housing 818 may have an axially oriented surface that corresponds to a complementary surface (not shown) on base 12. Wheel assembly 800 may be attached and secured to base 12 by screws, rivets, studs, bolts, and the like, which pass through holes 824. Alternatively, attaching mechanism 824 may include studs, shafts, or bolts, and then like that are received by the complementary surface of base 12.

During operation of wheel assembly 800, inner race 810 and motor housing 818 with motor 806 disposed therein remain stationary with respect to base 12 of device 10. Drive gear 812 drives ring gear 816 to rotate, thereby causing tire 802, rim 820, and outer race 808 to rotate with respect to base 12. Accordingly, drive gear 812 and ring gear 816 convert the rotational motion of shaft 814 to rotational motion of tire 802, which then causes device 10 to move forward or backward.

In a further embodiment, as shown in FIG. 11, outer race 808 of bearing 804 may be formed by a first portion 808A and a second portion 808B. First portion 808A may have a substantially cylindrical body that forms an axially outer wall 828A and a first radially side wall 828B for circular cavity 828 (FIGS. 9 and 10). Second portion 808B may have a substantially disc body that forms a second radially side wall 828C for circular cavity 828. Ring gear 816 may be disposed within circular cavity 828 on the first radially side wall 828B or the second radially side wall 828C.

Inner race 810 may be formed by a first portion 810A and a second portion 810B. First portion 810 may have a substantially cylindrical body that forms a radially inner wall 828D for circular cavity 828. Second portion 810B may have a circular frame or a disc body that forms a rim for inner race 810.

First portion 808A and second portions 808B of outer race 808 may be joined by welding, adhesive, screws, or other attaching means. Similarly, first portion 810A and second portion 810B of inner race 810 may also be joined by welding, adhesive, screws, or other attaching means. First portion 810A and second portion 810B of inner race 810 may both include frames 822 that form a cage for securing motor housing 828.

Figure 12:
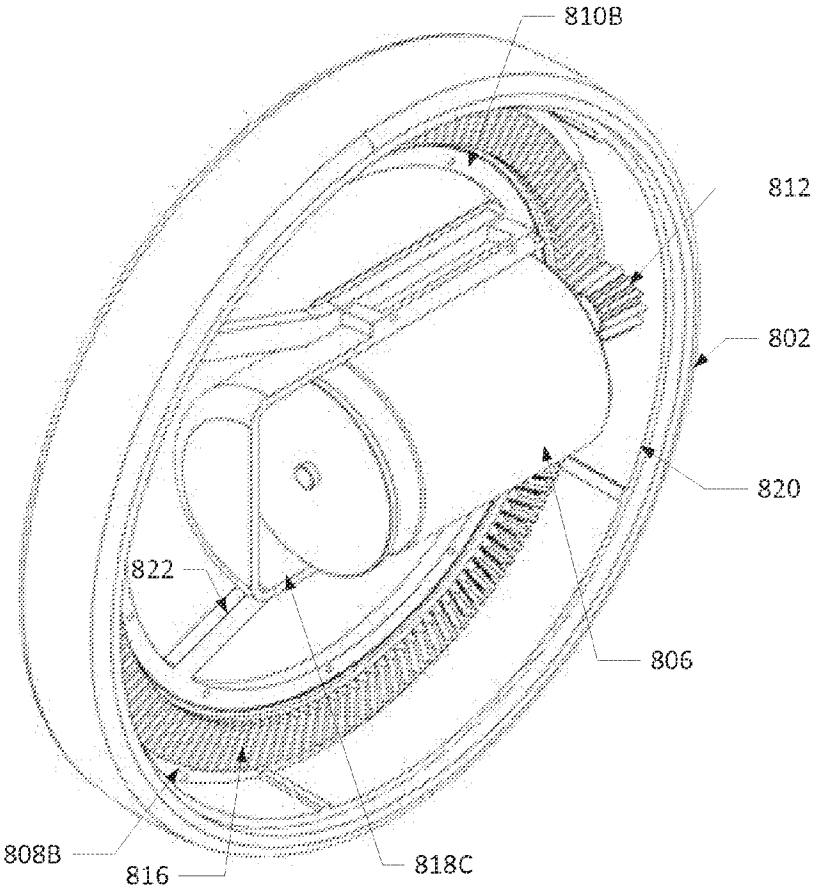
FIG. 12 shows a perspective view of the wheel assembly with the motorized transportation device according to one embodiment.
Figure 13:
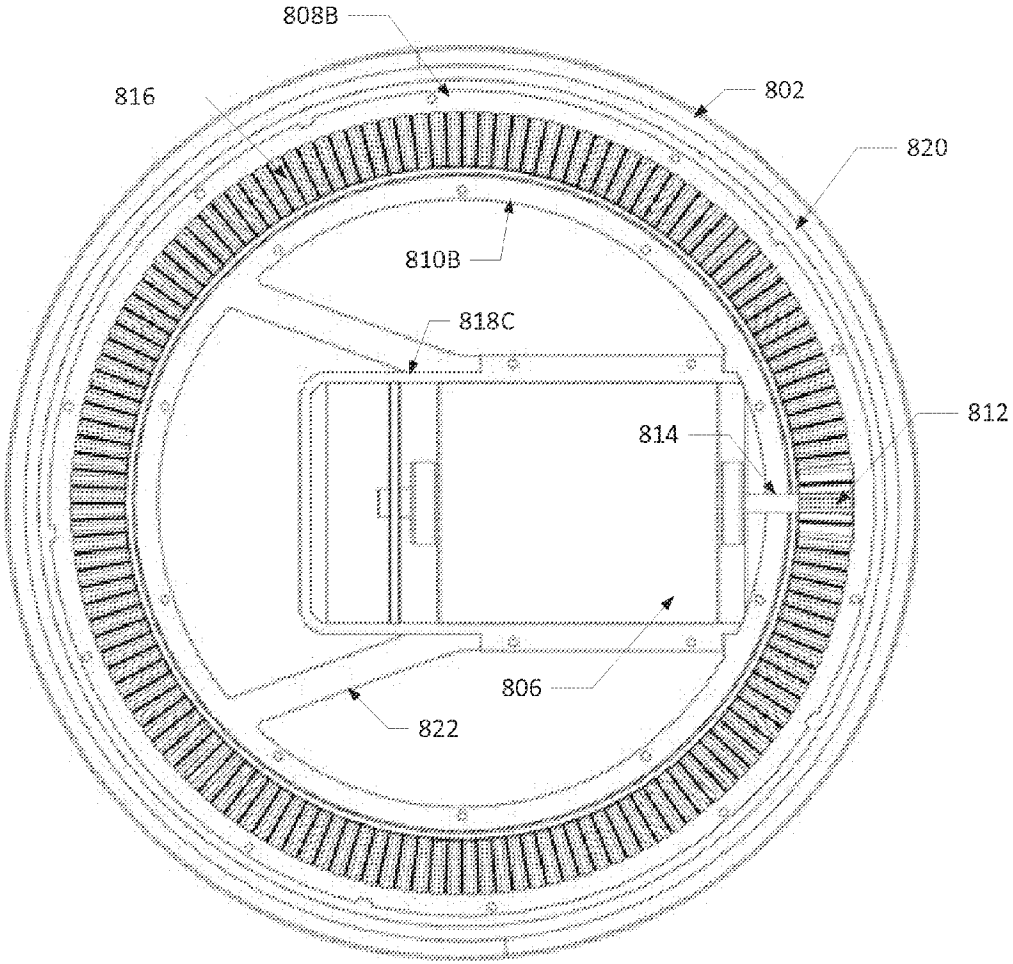
FIG. 13 shows a side view of the wheel assembly with the motorized transportation device according to one embodiment.
Figure 14:
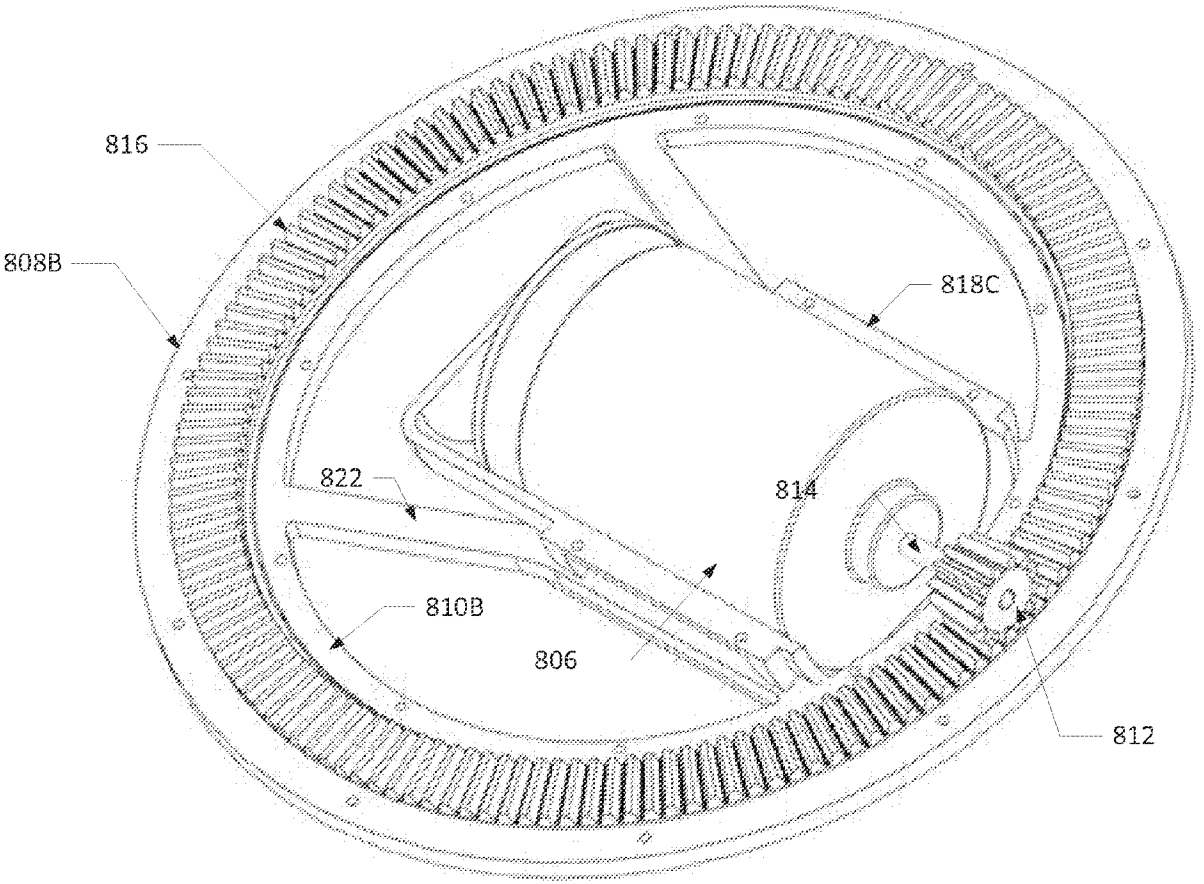
FIG. 14 shows a perspective view of the wheel assembly with the motorized transportation device according to one embodiment.

FIG. 12 shows a perspective view of wheel assembly 800, omitting first portion 808A of outer race 808, first portion 810A of inner race 810, second portion 808B of the upper motor housing, and second portion 808D of the lower motor housing. FIG. 13 shows a side view of wheel assembly 800, omitting first portion 808A of outer race 808, first portion 810A of inner race 810, second portion 808B of the upper motor housing, and second portion 808D of the lower motor housing. FIG. 14 shows a perspective views of wheel assembly 800, omitting first portion 808A of outer race 808, first portion 810A of inner race 810, second portion 808B of the upper motor housing, second portion 808D of the lower motor housing, rim 820, and tire 802.

The components and structures described herein may be modified or rearranged to reduce material usage, minimize weight and size, improve strength and durability, and simplify assembling and disassembling, without exceeding the scope of this disclosure. Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A wheel assembly comprising:

a wheel with a bearing that includes a circular inner race and a circular outer race that are rotatable with respect to each other, the outer race being mounted on the wheel;

a transmission assembly mounted on the wheel; and a motor coupled to the wheel through the transmission assembly, wherein the motor includes an axle extending in a radial direction of the wheel, and the transmission assembly transmits a rotational motion of the axle to a rotational motion of the wheel;

wherein the motor is secured to the inner race and is within the bearing.

2. The wheel assembly according to claim 1, wherein the transmission assembly comprises:

a first gear mounted on an interior surface of the wheel; and a second gear mounted at a distal end of the axle and engaged with the first gear.

3. The wheel assembly according to claim 2, wherein the first gear and the second gear are bevel gears.

4. The wheel assembly according to claim 2, wherein the first gear is a ring gear.

5. The wheel assembly according to claim 4, wherein the bearing is mounted on a rim of the wheel, outside of the ring gear and inside of an outer circumference of the rim.

6. The wheel assembly according to claim 1, wherein the wheel includes a tire and a rim, the tire is mounted on an exterior surface of the rim, and the outer race of the bearing is mounted on an interior surface of the rim.

7. The wheel assembly according to claim 1, wherein the inner race is mounted on a base of a transportation device.

8. The wheel assembly according to claim 1, wherein the outer race and the inner race form a plurality of circular channels and the bearing further includes a plurality of rolling elements disposed within the plurality of circular channels.

9. The wheel assembly according to claim 1, wherein the outer race and the inner race form a circumferential cavity, wherein the transmission assembly is disposed within the circumferential cavity.

10. The wheel assembly according to claim 1, wherein the outer race and inner race form a circumferential cavity, wherein at least a part of the axle is enclosed within the circumferential cavity.

11. A motorized transportation device, comprising:

a base, at least one wheel assembly, the at least one wheel assembly comprising:

a wheel with a bearing that includes a circular inner race and a circular outer race that are rotatable with respect to each other, the outer race being mounted on the wheel, the inner race being coupled to the base;

a transmission assembly mounted on the wheel; and a motor coupled to the wheel through the transmission assembly, wherein the motor includes an axle extending in a radial direction of the wheel, and the transmission assembly transmits a rotational motion of the axle to a rotational motion of the wheel; and a control system for controlling the motor;

wherein the motor is secured to the inner race and is within the bearing.

12. The motorized transportation device according to claim 11, wherein the transmission assembly comprises:

a first gear mounted on an interior surface of the wheel; and a second gear mounted at a distal end of the axle and engaged with the first gear.

13. The motorized transportation device according to claim 12, wherein the first gear and the second gear are bevel gears.

14. The motorized transportation device according to claim 12, wherein the first gear is a ring gear.

15. The motorized transportation device according to claim 14, wherein the bearing is mounted on a rim of the wheel, outside of the ring gear and inside of an outer circumference of the rim.

16. The motorized transportation device according to claim 11, wherein the wheel includes a tire and a rim, the tire is mounted on an exterior surface of the rim, and the outer race of the bearing is mounted on an interior surface of the rim.

17. The motorized transportation device according to claim 11, further comprising a forefoot cross member, which includes a battery pack.

18. The motorized transportation device according to claim 11, further comprising a heel support member, which includes a battery pack.

19. The motorized transportation device according to claim 18, further including a locking mechanism for securing the shoe to the base.

20. The motorized transportation device according to claim 19, wherein the locking mechanism includes a cable system and a strap that tightens the cable system.

21. The motorized transportation device according to claim 19, wherein the locking mechanism includes a cable system and a button, and when the button is rotated, the locking mechanism tightens the cable system.

22. The motorized transportation device according to claim 19, wherein the locking mechanism includes a heel support member that is activated when the user steps into the base, and when it is activated, it secures the user's heel on the base.

23. The motorized transportation device according to claim 22, wherein the heel support member is coupled to the base through a shaft and pivots on the shaft.

24. The motorized transportation device according to claim 23, wherein the position of the shaft is adjustable according to a size of the shoe.

25. The motorized transportation device according to claim 11, further including at least one additional wheel assembly coupled to the base through a suspension.

26. The motorized transportation device according to claim 25, wherein the suspension includes a spring member disposed between the base and the additional wheel assembly.

27. The wheel assembly according to claim 11, wherein the outer race and inner race form a circumferential cavity, wherein at least a part of the axle is enclosed within the circumferential cavity.

28. The motorized transportation device according to claim 11, wherein the motorized transportation device is a skate.

29. A wheel assembly comprising:

a wheel having a bearing that includes a circular inner race and a circular outer race that are rotatable with respect to each other, the outer race being mounted on the wheel, a ring gear disposed on an inner circumference of the wheel; and a motor disposed within the ring gear and secured to the inner race, the motor having a shaft and a gear mounted on an end of the shaft, wherein the gear of the motor engages the ring gear of the wheel to transmit a rotational motion of the shaft to a rotational motion of the wheel.

* * * * *